US005872090A

United States Patent [19]

You et al.

[11] Patent Number: 5,872,090

[45] Date of Patent: Feb. 16, 1999

[54] STAIN REMOVAL WITH BLEACH

[75] Inventors: Jing-Feng You, West Chester; Michael Peter Siklosi, Cincinnati, both of Ohio

[73] Assignee: The Procter & Gamble Company, Cincinnati, Ohio

[21] Appl. No.: 785,449

[22] Filed: Jan. 17, 1997

Related U.S. Application Data

[60] Provisional application No. 60/029,164 Oct. 25, 1996.

[51] Int. Cl.[6] ..... C11D 3/39

[52] U.S. Cl. ..... 510/284; 510/291; 510/309; 510/367

[58] Field of Search ..... 510/284

[56] References Cited

U.S. PATENT DOCUMENTS

| | | | |
|---|---|---|---|
| 1,747,324 | 2/1930 | Savitt . | |
| 3,432,253 | 3/1969 | Dixon | 8/142 |
| 3,591,510 | 7/1971 | Zenk | 252/137 |
| 3,593,544 | 7/1971 | Henderson | 68/12 |
| 3,633,538 | 1/1972 | Hoeflin | 118/76 |
| 3,647,354 | 3/1972 | Loeb | 8/158 |
| 3,686,126 | 8/1972 | Smeets | 510/284 |
| 3,737,387 | 6/1973 | Marple | 252/170 |
| 3,764,544 | 10/1973 | Haworth | 252/170 |
| 3,882,038 | 5/1975 | Clayton | 252/164 |
| 3,907,496 | 9/1975 | Néel | 8/142 |
| 3,949,137 | 4/1976 | Akrongold | 428/311 |
| 3,956,556 | 5/1976 | McQueary | 428/131 |
| 4,007,300 | 2/1977 | McQueary | 427/242 |
| 4,013,575 | 3/1977 | Castrantas et al. | 252/104 |
| 4,097,397 | 6/1978 | Mizutani | 252/153 |
| 4,102,824 | 7/1978 | Mizutani | 252/545 |
| 4,115,061 | 9/1978 | Grünewälder | 8/137 |
| 4,126,563 | 11/1978 | Barker | 252/8.8 |
| 4,130,392 | 12/1978 | Diehl | 8/101 |
| 4,139,475 | 2/1979 | Schwadtke et al. | 252/8.6 |
| 4,336,024 | 6/1982 | Denissenko | 8/142 |
| 4,395,261 | 7/1983 | Lutz | 8/111 |
| 4,530,781 | 7/1985 | Gipp | 510/284 |
| 4,532,722 | 8/1985 | Sax | 34/60 |
| 4,594,362 | 6/1986 | Smith | 521/52 |
| 4,606,842 | 8/1986 | Keyes | 252/174.23 |
| 4,659,496 | 4/1987 | Klemm | 252/90 |
| 4,692,277 | 9/1987 | Siklosi | 252/558 |
| 4,720,351 | 1/1988 | Flynn et al. | 510/284 |
| 4,758,641 | 7/1988 | Hsu | 526/208 |
| 4,797,310 | 1/1989 | Barby | 428/71 |
| 4,802,997 | 2/1989 | Fox | 252/8.6 |
| 4,806,254 | 2/1989 | Church | 252/8.6 |
| 4,849,257 | 7/1989 | Borcher | 427/242 |
| 4,886,615 | 12/1989 | Dehan | 252/90 |
| 4,909,962 | 3/1990 | Clark | 252/547 |
| 4,943,392 | 7/1990 | Hastedt | 252/539 |

(List continued on next page.)

FOREIGN PATENT DOCUMENTS

| | | | |
|---|---|---|---|
| 1005204 | 2/1977 | Canada | 8/93.11 |
| 0 208 989 | 1/1987 | European Pat. Off. | D06L 1/00 |
| 0 213 500 | 3/1987 | European Pat. Off. | C11D 17/00 |
| 0 261 718 | 3/1988 | European Pat. Off. | C11D 17/00 |
| 0 429 172 A1 | 5/1991 | European Pat. Off. | D06F 43/00 |
| 1397475 | 6/1975 | United Kingdom | C11D 10/02 |
| 1598911 | 9/1981 | United Kingdom | D06F 43/00 |
| 2302553 | 1/1997 | United Kingdom | D06F 43/00 |
| 2302878 | 2/1997 | United Kingdom | C11D 1/83 |
| 2302879 | 2/1997 | United Kingdom | C11D 1/12 |
| WO 91/09104 | 6/1991 | WIPO | C11D 7/32 |
| WO 91/13145 | 9/1991 | WIPO | C11D 7/50 |
| WO 93/25654 | 12/1993 | WIPO | C11D 7/50 |
| WO 96/39556 | 12/1996 | WIPO . | |
| WO 97/00990A2 | 1/1997 | WIPO . | |
| WO 97/00993A1 | 1/1997 | WIPO | D06L 1/02 |

OTHER PUBLICATIONS

Hunt, D.G. and N.H. Morris, "PnB and DPnB Glycol Ethers", *HAPPI,* Apr. 1989, pp. 78–82.

*Primary Examiner*—Ellen M. McAvoy
*Attorney, Agent, or Firm*—Steven R. Chuey; Kim W. Zerby; Jacobus C. Rasser

[57] ABSTRACT

Stains are removed from fabrics safely and effectively using a spot removal composition which contains peroxide.

11 Claims, 11 Drawing Sheets

U.S. PATENT DOCUMENTS

| | | | |
|---|---|---|---|
| 4,966,724 | 10/1990 | Culshaw | 252/158 |
| 4,983,317 | 1/1991 | Requejo | 252/174.24 |
| 5,004,557 | 4/1991 | Nagarajan | 252/174.24 |
| 5,041,230 | 8/1991 | Borcher | 252/8.9 |
| 5,062,973 | 11/1991 | Kellett | 252/8.75 |
| 5,080,822 | 1/1992 | VanEenam | 252/170 |
| 5,102,573 | 4/1992 | Han | 252/153 |
| 5,112,358 | 5/1992 | Deal | 8/137 |
| 5,173,200 | 12/1992 | Kellett | 252/8.8 |
| 5,213,624 | 5/1993 | Williams | 134/40 |
| 5,238,587 | 8/1993 | Smith | 252/8.6 |
| 5,492,540 | 2/1996 | Leifheit | 8/111 |
| 5,547,476 | 8/1996 | Siklosi | 8/142 |
| 5,591,236 | 1/1997 | Roetker | 8/137 |
| 5,630,847 | 5/1997 | Roetker | 510/291 |
| 5,632,780 | 5/1997 | Siklosi | 510/281 |
| 5,681,355 | 10/1997 | Davis et al. | 510/281 |
| 5,687,591 | 11/1997 | Siklosi et al. | 68/212 |

STAIN REMOVAL WITH BLEACH

FIELD OF THE INVENTION

The present invention relates to compositions which can be used to remove stains from fabrics. The compositions are especially useful in a spot-removal step of a non-immersion fabric cleaning operation, but can also be used under any circumstances where spot removal from fabrics is desired.

CROSS REFERENCE

This application claims priority under Title 35, United States Code 119(e) from Provisional Application Serial No. 60/029,164, filed Oct. 25, 1996.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

While solvent-based dry cleaning processes are quite effective for removing oily soils and stains, they are not optimal for removing particulates such as clay soils, and may require special treatment conditions to remove proteinaceous stains. Ideally, particulates and proteinaceous stains are removed from fabrics using detersive ingredients and operating conditions which are more akin to aqueous laundering processes than to conventional dry cleaning.

In addition to the cleaning function, conventional dry cleaning processes also provide important "refreshment" benefits. For example, dry cleaning removes undesirable odors and extraneous matter such as hair and lint from garments, which are then generally folded or pressed to remove wrinkles and restore their original shape. Of course, such refreshment benefits are also afforded by aqueous laundering processes.

As can be seen from the foregoing, and aside from the effects on certain fabrics such as woolens, there are no special, inherent advantages for solvent-based immersion dry cleaning over aqueous cleaning processes with respect to fabric cleaning or refreshment. Moreover, on a per-garment basis, commercial dry cleaning is much more expensive than aqueous cleaning processes. Accordingly, it would be of considerable benefit to consumers to provide non-immersion processes for cleaning "dry-clean only" fabrics which can be used in the home.

One type of home cleaning system comprises a carrier sheet containing various cleaning agents, and a plastic bag. The garments to be cleaned are placed in the bag together with the sheet, and then tumbled in a conventional clothes dryer. In a commercial embodiment, multiple single-use flat sheets and a single multi-use plastic bag are provided in a package. Unfortunately, such processes may not satisfactorily remove stains from heavily soiled or "spotted" areas of the fabrics being dry cleaned.

As is well known, heavily stained garments may be "pre-spotted" using so-called "spot removal" compositions prior to cleaning. Improved spot-removal procedures use devices which allow the user to pre-spot fabrics without resort to rubbing, thereby minimizing fabric damage. Such devices are designed to work in concert with pre-spotting compositions to loosen and remove stains via controlled mechanical action, thereby avoiding fabric damage. Briefly stated, such devices are designed to gently implement Z-axis mechanics only, with respect to the fabric being treated. Indeed, preferred devices actually promote Z-axis mechanics and dissuade the user from employing an undesirable side-to-side rubbing motion.

However, it has now been discovered that, even when using preferred cleaning devices in combination with pre-spotting compositions, some spots and stains may not be removed from the fabrics in optimal fashion. This is especially true in home-use cleaning, wherein the operator has had no special training in the spot removal operation. For example, certain food stains such as spaghetti sauce, ketchup, coffee, tea, wine, and the like, contain color bodies which may be incompletely removed from the fabric by conventional pre-spotting compositions. By the present invention it has been discovered that the use of a peroxide bleach, especially hydrogen peroxide, preferably in combination with solvents and a major proportion of water, and most preferably with a chelating agent, efficiently and effectively removes such stains.

BACKGROUND ART

A peracid-containing dry cleaning composition is described in U.S. Pat. No. 4,013,575, issued to H. Castrantas, et al., Mar. 22, 1977. Dry cleaning processes are disclosed in: U.S. Pat. No. 5,547,476, issued to Siklosi and Roetker; EP 429,172A1, published May 29, 1991, Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. No. 3,956,556 and 4,007,300 relate to perforated sheets for fabric conditioning in a clothes dryer. U.S. Pat. No. 4,692,277 discloses the use of 1,2-octanediol in liquid cleaners. See also U.S. Pat. Nos. 3,591,510; 3,737,387; 3,764,544; 3,882,038; 3,907,496; 4,097,397; 4,102,824; 4,336,024; 4,606,842; 4,758,641; 4,797,310; 4,802,997; 4,943,392; 4,966,724; 4,983,317; 5,004,557; 5,062,973; 5,080,822; 5,173,200; EP 0 213 500; EP0 261 718; G.B. 1,397,475; WO 91/09104; WO 91/13145; WO 93/25654 and Hunt, D. G. and N. H. Morris, "PnB and DPnB Glycol Ethers", *HAPPI,* April 1989, pp. 78–82.

SUMMARY OF THE INVENTION

The present invention encompasses a spot cleaning composition for use on fabrics, comprising:

(a) at least about 89%, by weight, of water;

(b) from about 0% to about 10%, by weight, of an organic cleaning solvent;

(c) from about 0.25% to about 7%, by weight, of a peroxide source;

(d) optionally, but preferably, a detersive surfactant and (d) optionally, but preferably, a peroxide-stabilizing amount of a chelating agent.

In a preferred embodiment, the organic cleaning solvent is butoxy propoxy propanol. The peroxide source is preferably hydrogen peroxide. The chelating agent is preferably an amino phosphonate chelator, such as amino tris(methylene phosphonic) acid or water-soluble salt thereof.

It will be appreciated by those skilled in the dry-cleaning art that the potential for dye (or fabric) damage might have been thought to be increased by the use of peroxide in the present pre-spotting compositions. This is particularly true when pre-spotting fabrics which have dyes which contain transition metals such as chromium or cobalt, or which have picked-up traces of iron during processing. This potential for fabric damage is further exacerbated by the presence of chloride ions in the fabric, e.g., from perspiration. Moreover, since the overall in-dryer process herein does not include an aqueous rinse step, the potential for dye or fabric damage would seem to be still further increased.

However, and contrary to the foregoing expectations, it has now been discovered that the potential for dye/fabric damage is minimized or eliminated by formulating the pre-spotting compositions herein within the following parameters. First, the amount of hydrogen peroxide used is kept low, typically about 0.25% to about 3%, preferably about 1%, by weight, in the compositions. Second, the amount of non-volatile ingredients in the compositions is also kept low. While not intending to be limited by theory, it may reasonably be hypothesized that such ingredients can entrap the peroxide on the fabric surface, thereby increasing the potential for damage by retarding evaporation of any excess peroxide. In particular, it has now been discovered that the level of detersive surfactant used in the composition may potentiate such dye/fabric damage. Thus, by properly formulating the compositions to employ low usage levels, i.e., no more than about 0.75%, preferably from about 0.1% to about 0.5%, by weight, of detersive surfactants, the potential for damage is minimized or eliminated. Of course, with some types of dyes and/or fabrics, the damage potential is inherently minimal or non-existent, so higher levels of peroxide and/or surfactants can be employed.

Highly preferred liquid compositions comprise from about 95% to about 99%, by weight, of water and are formulated at a pH of from about 3 to about 8.

The invention also encompasses a method for removing stains from a stained area of fabrics using a device as described hereinafter, comprising the steps of:

(a) applying the peroxide-containing spot cleaning composition of the foregoing type to said stained area;

(b) concurrently or consecutively with Step (a), contacting the stained area of the fabrics with the treatment members of said device; and (c) applying force to said device, especially by using a rocking motion which is imparted to the device, conveniently, by hand.

The process herein can be conducted on any convenient surface such as a table top which supports the fabric being treated. In one mode, the process is conducted in conjunction with a receptacle situated beneath the stained area of the fabrics, whereby an environment which is saturated or partially saturated with liquid spot cleaning composition is achieved. In another mode, the process is conducted in conjunction with an absorbent stain receiver which is situated beneath the stained area of the fabric. In this mode, stain components which are transmitted through the fabric by the co-action of the cleaning device herein and the composition are absorbed into the stain receiver and not re-absorbed into the cleaned fabric.

The invention also encompasses an overall non-immersion cleaning/refreshment process for treating a stained fabric, which comprises a prespotting operation employing a device according to the above, and comprising the overall steps of:

(a) applying the peroxide-containing spot cleaning composition of the foregoing type to said stained area;

(b) concurrently or consecutively with Step (a), contacting the stained area of the fabrics with the treatment members of a cleaning device such as those described hereinafter;

(c) applying force to said device, preferably using a rocking motion;

(d) placing the prespotted fabric together with a carrier containing an aqueous cleaning/refreshment composition in a containment bag which is most preferably constructed such that vapors are vented from the bag during step (e), hereafter;

(e) placing the bag in a hot air clothes dryer or other hot air apparatus and operating the dryer with heat and tumbling; and (f) removing the fabric from the bag.

The invention also encompasses an overall laundering process for treating a stained area of fabric, which comprises a prespotting operation employing a peroxide-containing spot cleaning composition and a cleaning device, comprising the overall steps of:

(a) applying said peroxide-containing spot cleaning composition to said stained area;

(b) concurrently or consecutively with Step (a), contacting the stained area of the fabrics with the treatment members of said device;

(c) applying force to said device, preferably using a rocking motion; and (d) laundering the fabrics in a conventional aqueous laundering process.

The invention also encompasses a cleaning kit for non-immersion "dry" cleaning of fabrics, comprising:

(a) a device as disclosed herein;

(b) a peroxide-containing spot cleaning composition;

(c) a re-usable, preferably vapor-venting, containment bag;

(d) multiple, single-use sheets releasably containing a cleaning and/or fabric refreshment composition; and (e) optionally, a re-usable holding tray; and (f) optionally, one or more absorbent stain receivers.

The kit can additionally contain usage instructions which promote the use of a downward rocking (and/or rolling) motion with said device and which discourage the use of a side-to-side scrubbing motion. The usage instructions can also be included on the device, itself.

All percentages, ratios and proportions herein are by weight, unless otherwise specified. All documents cited are, in relevant part, incorporated herein by reference.

comprising the hand grip assembly separated from the sponge layer (205) and the layer of fibrous protuberances (206) which perform the cleaning function.

Figure 4:
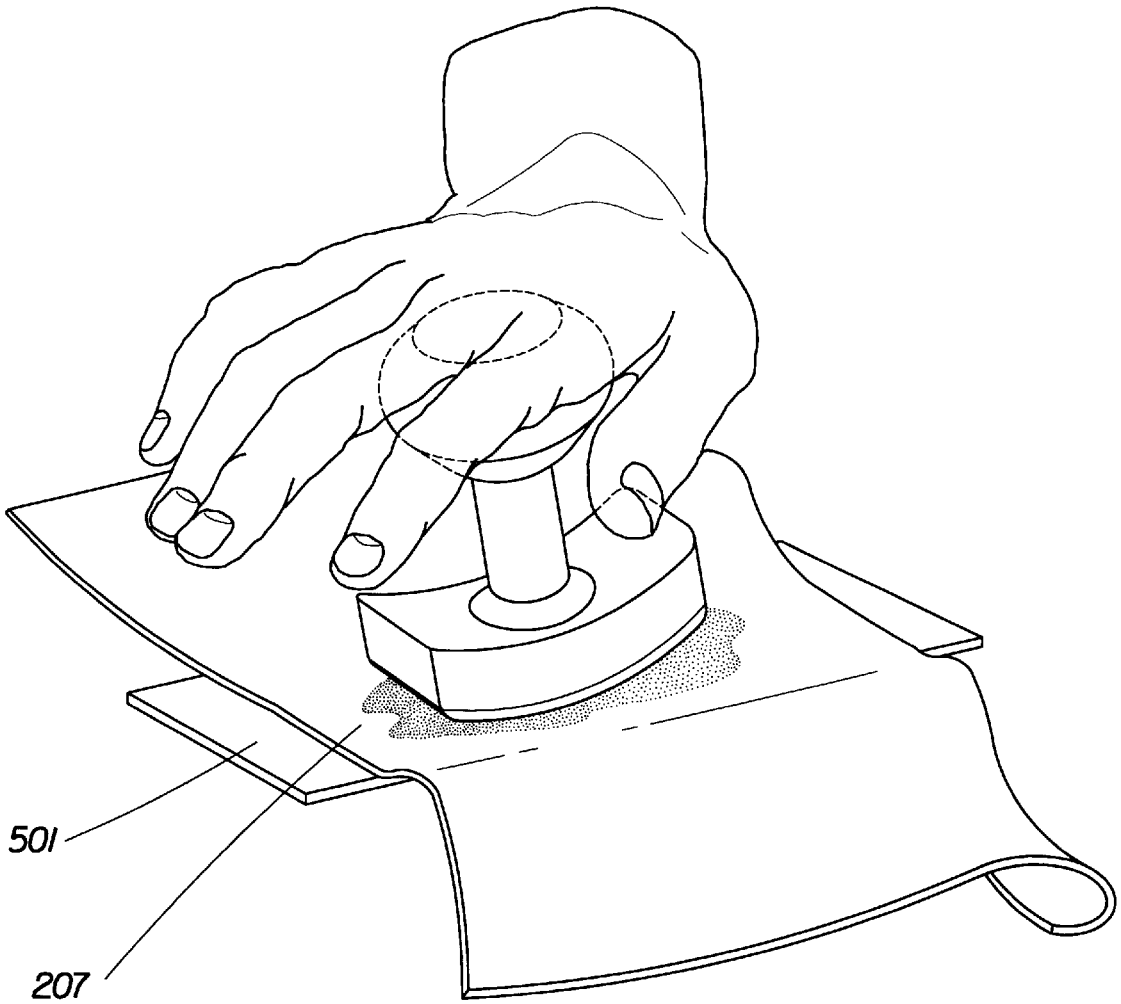

FIG. 4 illustrates the use of the device by using hand pressure to rock the device, thereby causing the protuberances which extend outwardly from the convex head to impinge on the stained (207) fabric and to impart a cleaning force perpendicular to the stain. Undesirable side-to-side (shear) forces on the fabric are thus minimized or eliminated. A stain receiver pad (501) is shown underlaying the stained area of fabric.

Figure 5:
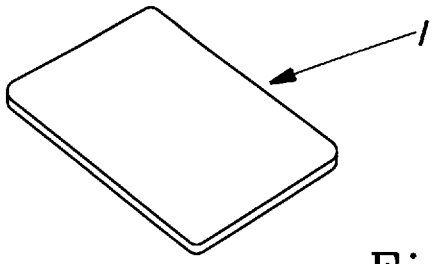

FIG. 5 is a perspective of a cleaning/refreshing sheet (1) of the type used herein.

Figure 6:
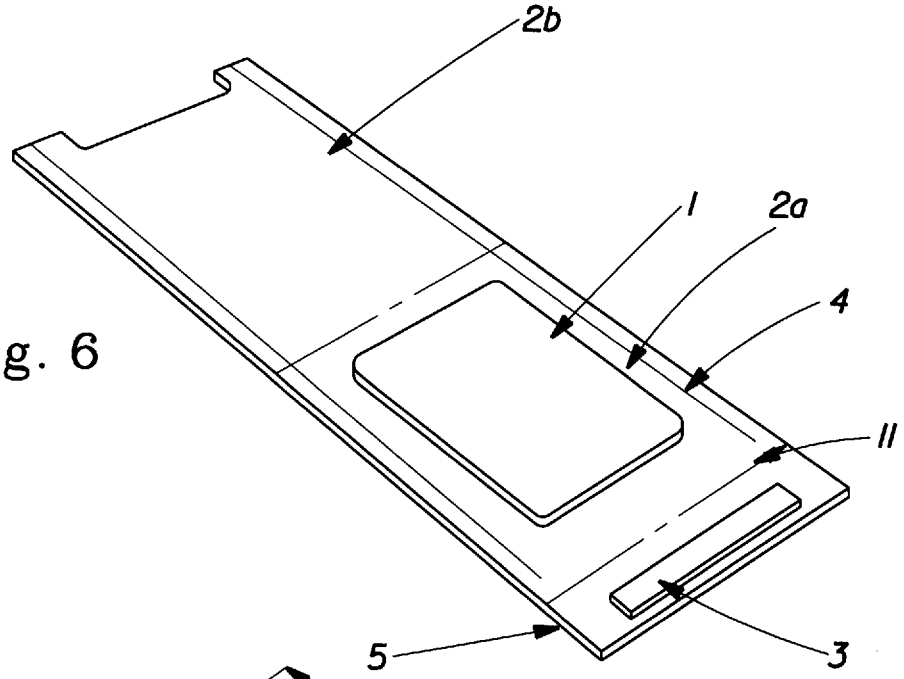

FIG. 6 is a perspective of the sheet loosely resting on a notched, vapor-venting containment bag which is in a pre-folded condition.

Figure 7:
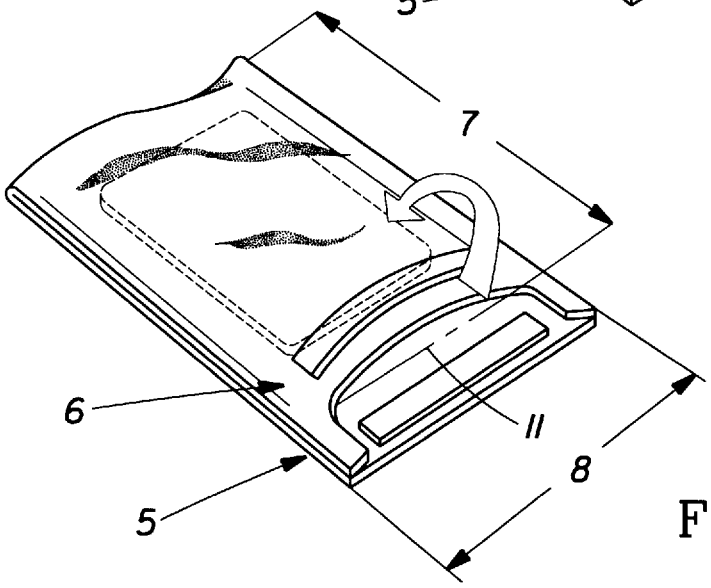

FIG. 7 is a perspective of the sheet loosely resting within the bag which is ready to receive the fabrics to be treated in a hot air clothes dryer.

Figure 8:
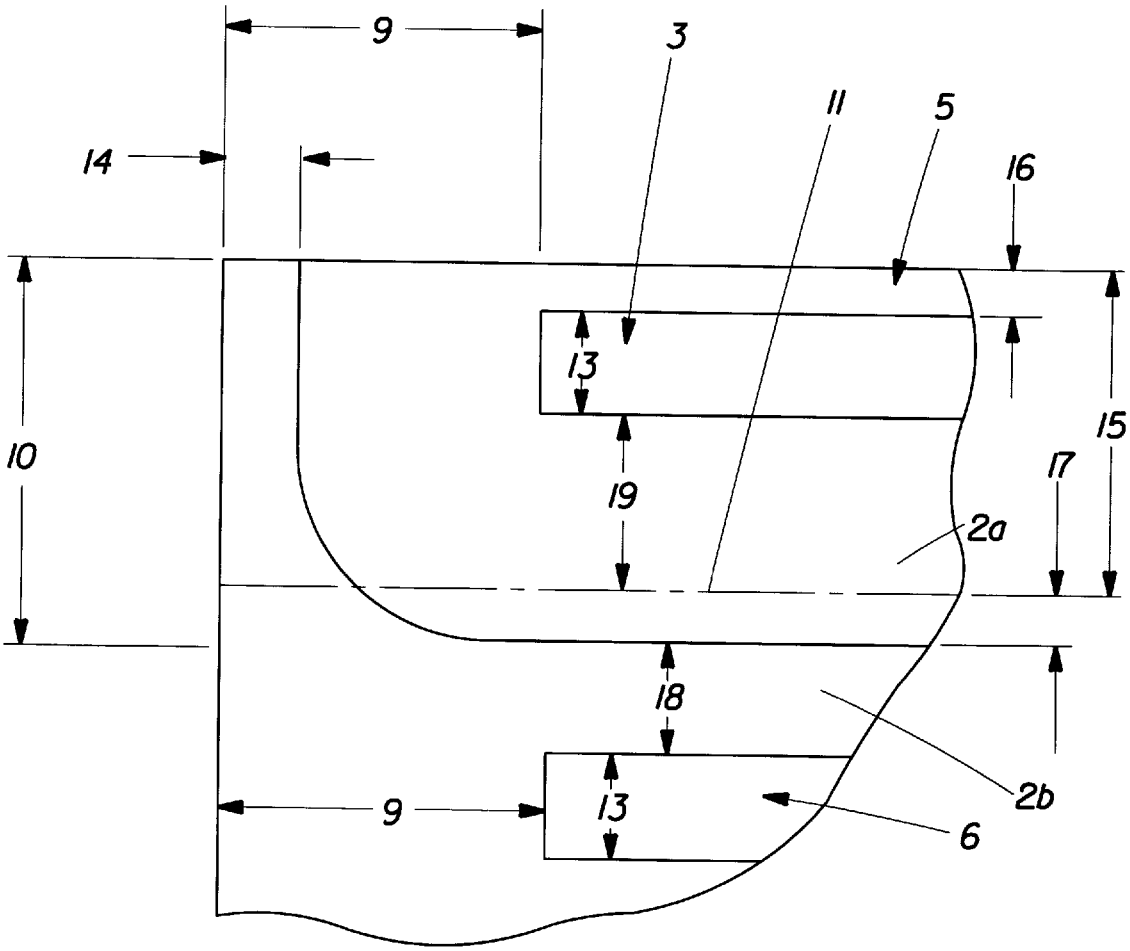

FIG. 8 is a partial view of the notched wall of the bag and its disposition relative to the closure flap.

Figure 9:
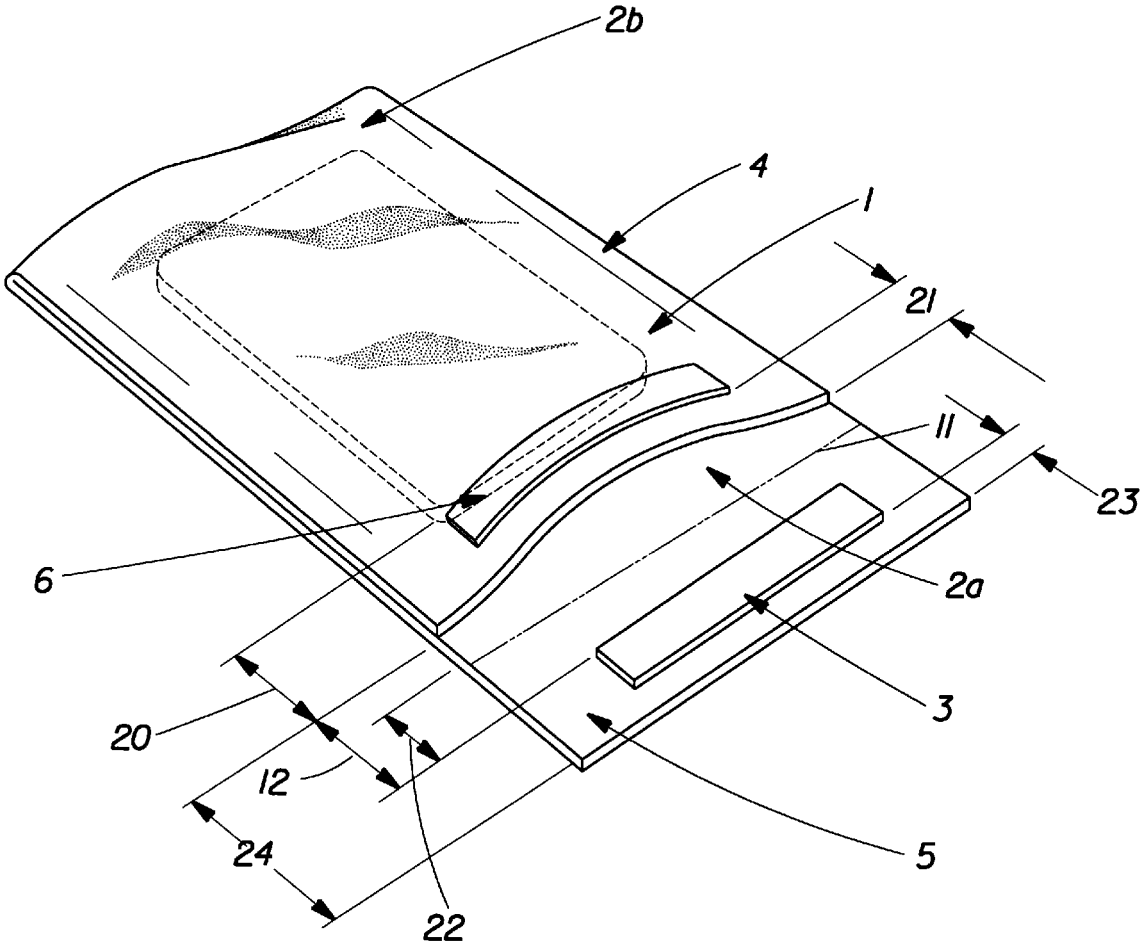

FIG. 9 is a perspective of an un-notched vapor-venting bag containing a loose cleaning/refreshment sheet.

Figure 10:
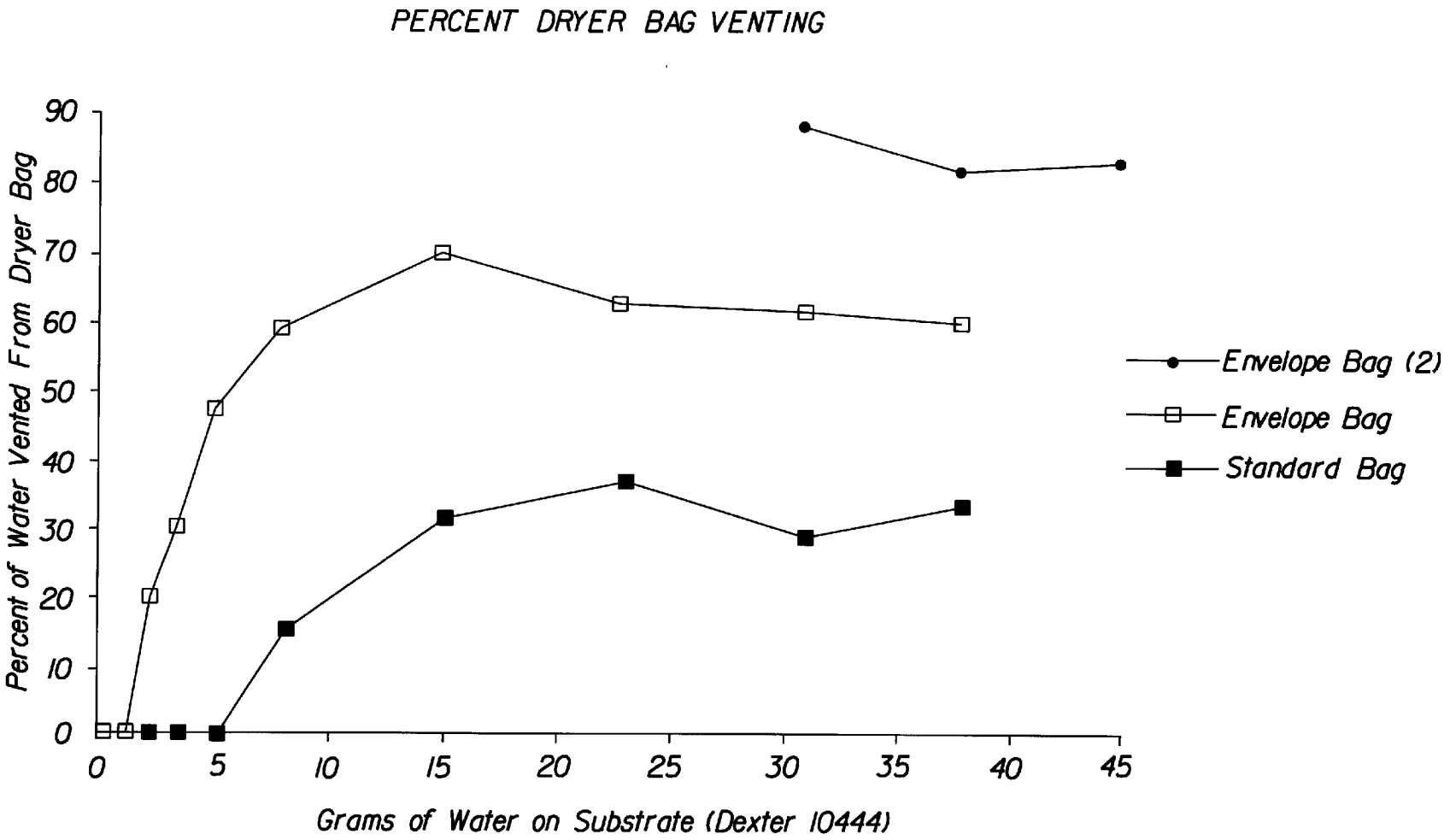

FIG. 10 is a graph of water venting from a vapor-venting "Envelope"-style Bag with the vapor-venting closure, from a Standard Bag, i.e., a sealed bag without the venting closure (as control for comparison purposes); and from an "Envelope Bag (2)" which has a vapor venting closure at each end.

Figure 11:
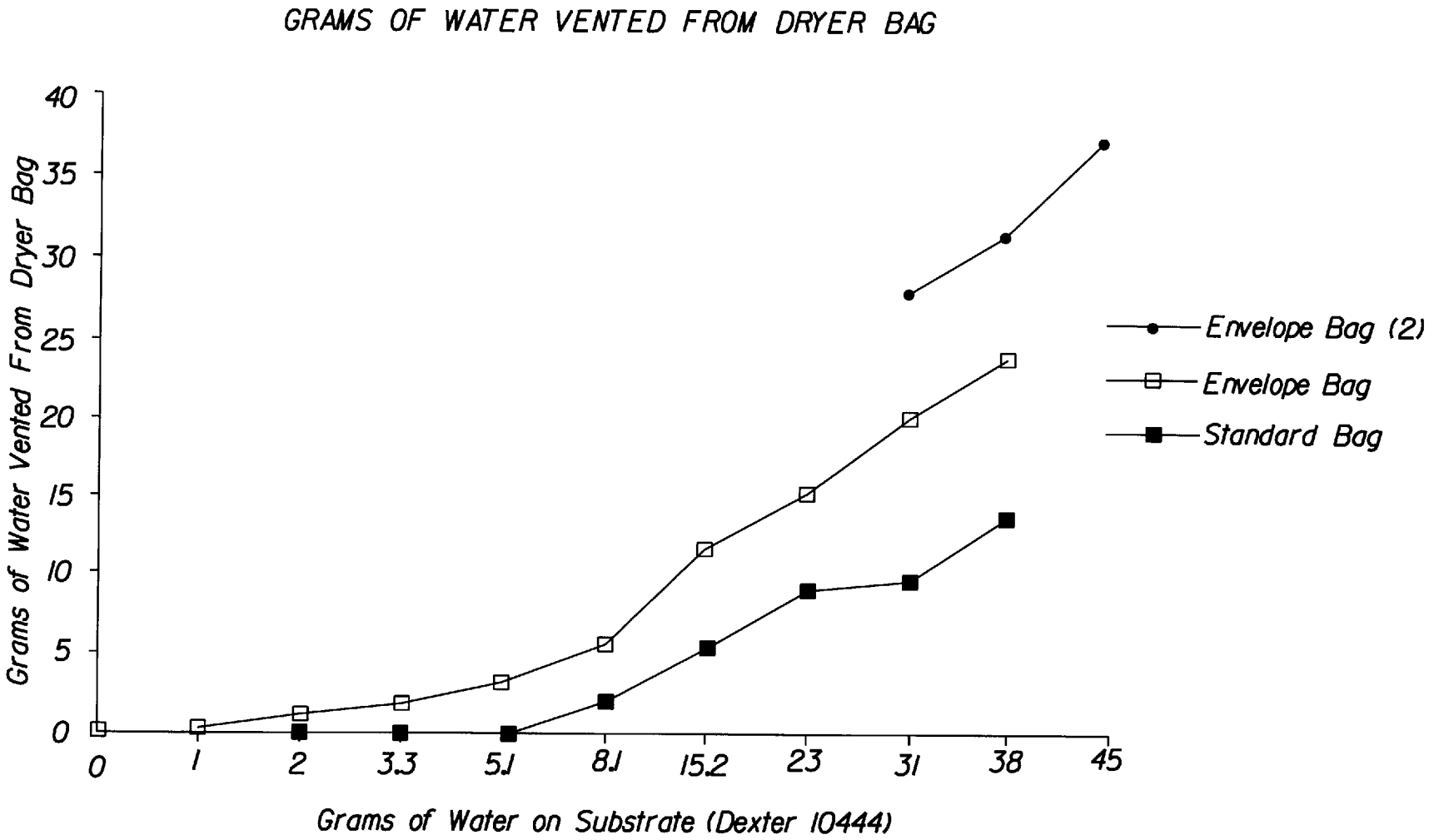

FIG. 11 is a graph of water venting as in FIG. 10, expressed in grams.

Figure 12:
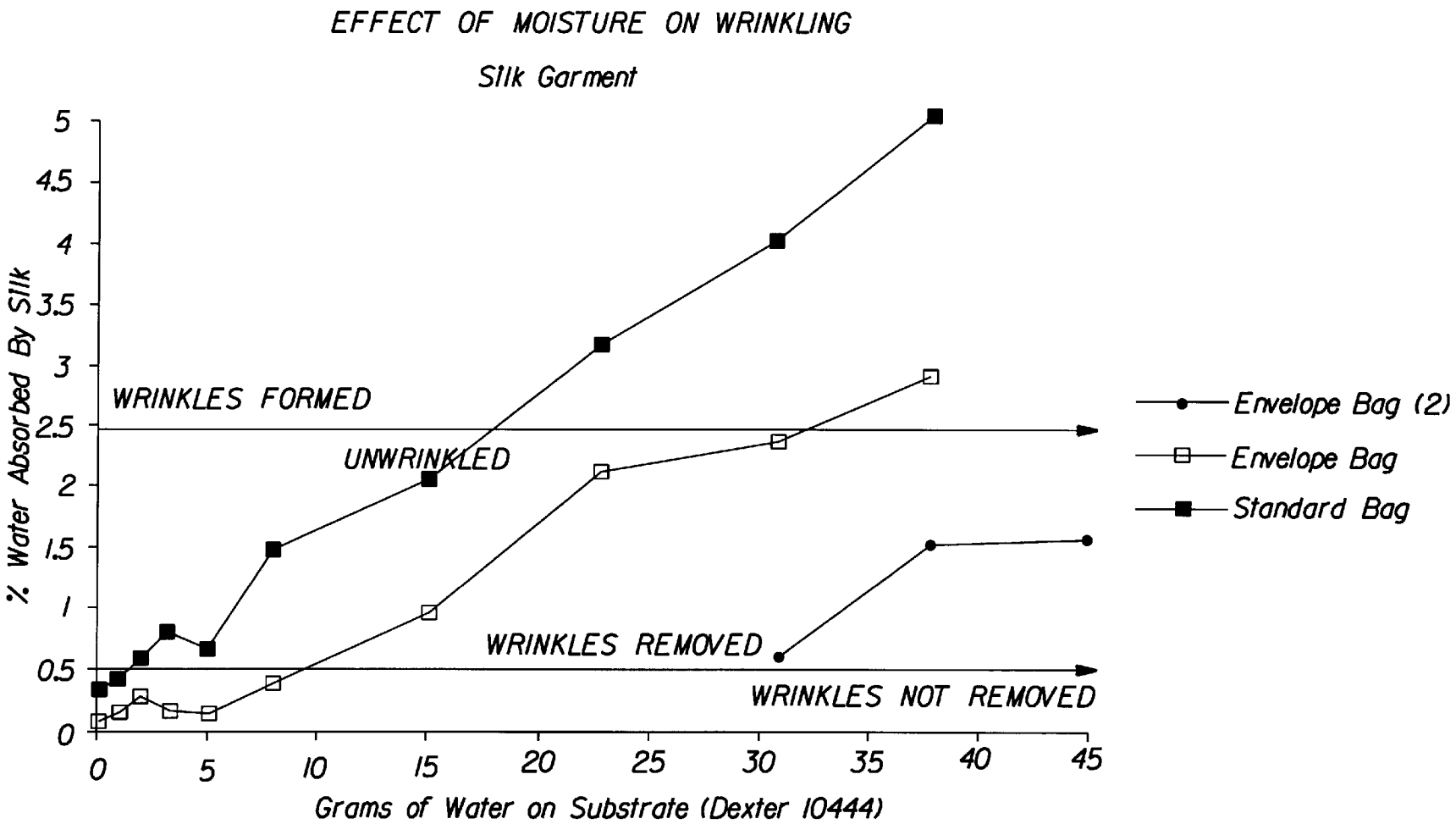

FIG. 12 is a graph which shows the relationship between operating regions of the present process with respect to fabrics wherein Wrinkles Form, Unwrinkled, Wrinkles Removed, and Wrinkles Not Removed.

Figure 13:
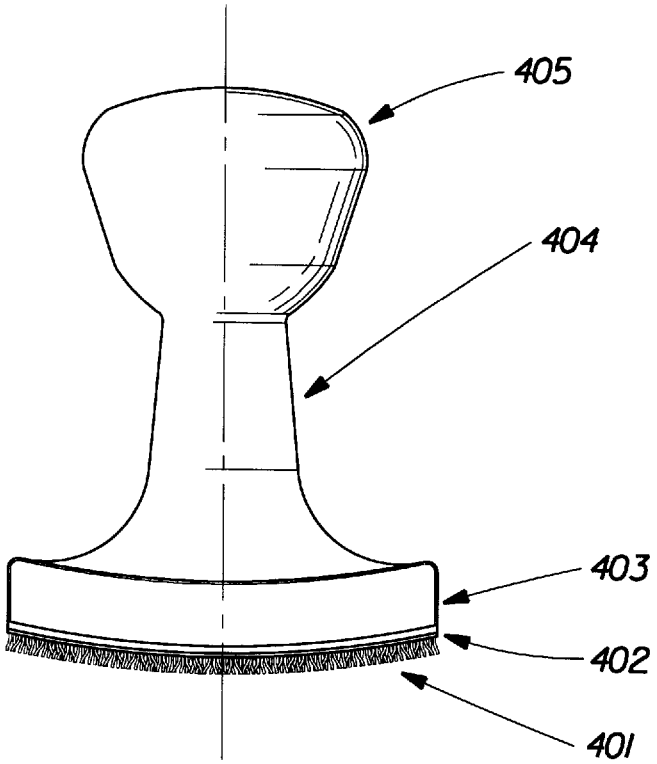

FIG. 13 is a preferred arcuate device for use herein.

DETAILED DESCRIPTION OF THE INVENTION

Compositions—One problem associated with known fabric pre-spotting compositions is their tendency to leave visible residues on fabric surfaces. Such residues are problematic and are preferably to be avoided herein since the present process does not involve conventional immersion or rinse steps. Accordingly, the pre-spotting compositions herein should, most preferably, be substantially free of various polyacrylate-based emulsifiers, polymeric anti-static agents, inorganic builder salts and other residue-forming materials, except at low levels of about 0.1%–0.3%, and preferably 0%, of the final compositions. Water used in the compositions should preferably be distilled, deionized or otherwise rendered free of residue-forming materials. Stated otherwise the compositions herein should be formulated so as to leave substantially no visible residue on fabrics being treated according to the practice of this invention.

Accordingly, in a preferred aspect of this invention there are provided pre-spotting (i.e., spot-cleaning) compositions which are substantially free of materials which leave visible residues on the treated fabrics. This necessarily means that the preferred pre-spotting compositions are formulated to contain the highest level of volatile materials possible, preferably water, typically about 95%, preferably about 97.7%, a cleaning solvent such as BPP at a low, but effective, level, typically about 1% to about 4%, preferably about 2%, and surfactant at levels of about 0.1% to about 0.7%. Advantageously, when thus formulated such compositions exist as phase-stable aqueous solutions rather than as suspensions or emulsions. Thus, such compositions do not require use of additional emulsifiers, thickening agents, suspending agents, and the like, all of which can contribute to the formation of undesirable visible residues on the fabric.

It is, of course, necessary that the pre-spotting compositions herein perform their spot-removal function efficiently and effectively. It has now been discovered that use of the cleaning device, with the application of downward force (Z-direction) in the manner disclosed herein, provides good spot and stain removal performance even with the aforesaid high water pre-spotting composition solutions. Further details of such pre-spotting compositions are as described hereinafter in the Examples.

Indeed, as an overall proposition, the chemical compositions which are used to provide the pre-spotting and the overall cleaning and/or refreshment functions herein comprise ingredients which are safe and effective for their intended use, and, as noted above, do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dye from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred compositions herein are formulated to minimize or avoid this problem.

The dye removal attributes of the present compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or rayon fabrics) is treated by padding-on cleaner/refresher compositions using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) "I see a lot of dye on the towel"; through (4) "I know I see quite a lot of dye on the towel" are assigned by panelists.

In addition to the foregoing considerations, the compositions used herein are referably formulated such that they are easily dispensed and not so adhesive in nature that they render the spot-cleaning device unhandy or difficult to use. However, and while not intending to be limiting of the present invention, the preferred compositions disclosed herein afford a spot-cleaning process which is both effective and aesthetically pleasing when used with a device in the manner disclosed herein.

Aqueous Spot Stain Cleaning Compositions (a) Bleach—The compositions herein comprise from about 0.25% to about 7%, by weight, of hydrogen peroxide.

Preferred spot cleaners will comprise 0.5 to about 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Solvent—The compositions herein may comprise from about 0% to about 10%, by weight, of butoxy propoxy propanol (BPP) solvent. Preferred spot cleaners will comprise 1–4% BPP.

(c) Water—The preferred, low residue compositions herein may comprise from about 90%, preferably from about 95.5% to about 99%, by weight, of water.

(d) Surfactant—The compositions herein may optionally comprise from about 0.05% to about 2%, by weight, of surfactants, such as ethoxylated alcohols or alkyl phenols, alkyl sulfates, MgAES, $NH_4$AES, amine oxides, and mixtures thereof. As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP/0.25% NEODOL 23 6.5. Another preferred composition comprises 4% BPP/0.4% AS.

(e) Optionals—The compositions herein may comprise minor amounts of various optional ingredients, including bleach stabilizers, perfumes, preservatives, and the like. If used, such optional ingredients will typically comprise from about 0.05% to about 2%, by weight, of the compositions, having due regard for residues on the cleaned fabrics.

(f) Chelator—The chelating agent is selected from those which, themselves, are stable in aqueous $H_2O_2$ and which stabilize the $H_2O_2$ by chelating vagrant metal ions. Such chelating agents are typically already present at low, peroxide-stabilizing amounts (0.01–1%) in commercial sources of hydrogen peroxide.

The pH range of the pre-spotting compositions helps provide stability to the hydrogen peroxide and is typically in the acid-slightly basic range from about 3 to about 8, preferably about 6.

Organic Solvent—The preferred cleaning (especially including spot cleaning) solvent herein is butoxy propoxy propanol (BPP) which is available in commercial quantities as a mixture of isomers in about equal amounts. The isomers, and mixtures thereof, are useful herein. The isomer structures are as follows:

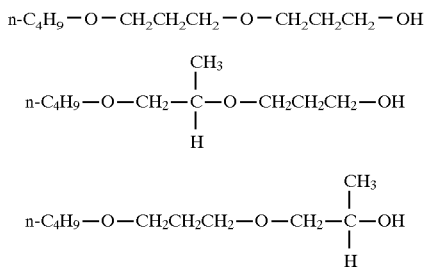

While the spot cleaning compositions herein function quite well with only the BPP, water and surfactant, they may also optionally contain other ingredients to further enhance their stability. Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein.

Surfactants—Nonionics such as the ethoxylated $C_{10}$–$C_{16}$ alcohols, e.g., NEODOL 23-6.5, can be used in the compositions. The alkyl sulfate surfactants which may be used herein as cleaners and to stabilize aqueous compositions are the $C_8$–$C_{18}$ primary ("AS"; preferred $C_{10}$–$C_{14}$, sodium salts), as well as branched-chain and random $C_{10}$–$C_{20}$ alkyl sulfates, and $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$–$C_{16}$ alkyl, EO is —$CH_2CH_2$—O—, x is 1–10 and can include mixtures which are conventionally reported as averages, e.g., $(EO)_{2.5}$, $(EO)_{6.5}$ and the like, and Z is a cation such as sodium ammonium or magnesium (MgAES). The $C_{12}$–$C_{16}$ alkyl dimethyl amine oxide surfactants can also be used. A preferred mixture comprises $MgAE_1S/C_{12}$ dimethyl amine oxide at a weight ratio of about 10:1. Other surfactants which improve phase stability and which optionally can be used herein include the polyhydroxy fatty acid amides, e.g., $C_{12}$–$C_{14}$ N-methyl glucamide. AS stabilized compositions preferably comprise 0.1%–0.5%, by weight, of the compositions herein. MgAES and amine oxides, if used, can comprise 0.01%–2%, by weight, of the compositions. The other surfactants can be used at similar levels.

Having due regard to the foregoing considerations, the following illustrates the various other ingredients which can be used in the liquid compositions herein, but is not intended to be limiting thereof. In general, the spot cleaning compositions are formulated to be somewhat "stronger" in cleaning power than the cleaning/refreshment compositions, although this can be varied, according to the desires of the formulator.

Other Optionals—In addition to the water, the preferred BPP solvent and the AS surfactant solvent disclosed above, the phase-stable liquid compositions used herein may comprise various optional ingredients, such as perfumes, preservatives, brighteners, salts for viscosity control, pH adjusters or buffers, and the like. The following illustrates preferred ranges for cleaning compositions for use herein, but is not intended to be limiting thereof

| Ingredient | % (wt.) Formula Range |
|---|---|
| BPP | 0.05–5 |
| AS | 0.05–2 |
| Perfume | 0.01–1.5 |
| Water | Balance |
| pH range from about 6 to about 8. | |

Other solvents or co-solvents which can optionally be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and BPP, as well as butoxy propanol (BP), and the like, and mixtures thereof. If used, such solvents or co-solvents will typically comprise from about 0.5% to about 2.5%, by weight, of the aqueous compositions herein. Non-aqueous (less than 50% water) compositions which optionally can be used in the pre-spotting step, can comprise the same solvents.

Other preferred compositions herein are as follows.

| Ingredient | % (wt.) | Range (% wt.) |
|---|---|---|
| Water | 99.0 | 95.1–99.9 |
| Perfume | 0.5 | 0.05–1.5 |
| Surfactant* | 0.5 | 0.05–2.0 |
| Ethanol or Isopropanol | 0 | Optional to 4% |

*Especially ethoxylated alcohols, as disclosed herein. The fabric refreshment compositions may also contain anionic surfactants. Such anionic surfactants are well-known in the detergency arts. Commercial surfactants available as TWEEN ®, SPAN ®, AEROSOL OT ® and various sulfosuccinic esters are especially useful herein.

Chelating Agents—The compositions herein may also optionally, but preferably, contain one or more chelating agents to stabilize the $H_2O_2$. As noted above, the selection of chelating agents is typically within the purview of the manufacturer of the aqueous $H_2O_2$ used herein. A variety of phosphonate chelators are known in stabilizing $H_2O_2$. The amino phosphonates are especially useful for this purpose. Various amino phosphonates are available as under the DEQUEST® trade name from the Monsanto Company, St. Louis, Mo. Representative, but non-limiting, examples include ethylenediamine tetrakis (methylene phosphonic) acid, diethylenetriamine penta(methylene phosphonic) acid, and the water-soluble salts thereof. Amino tris(methylene phosphonic) acid or its water-soluble salts (as DEQUEST 2000®) is a preferred chelator.

Figure 1:
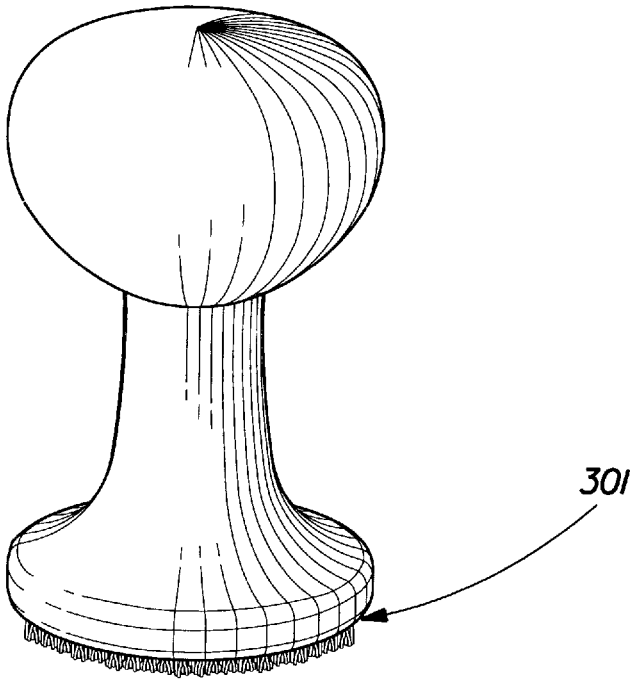
FIG. 1 is a perspective of a spot cleaning device of the type used herein having a convex base (301) whose circumference is substantially circular.
Figure 2:
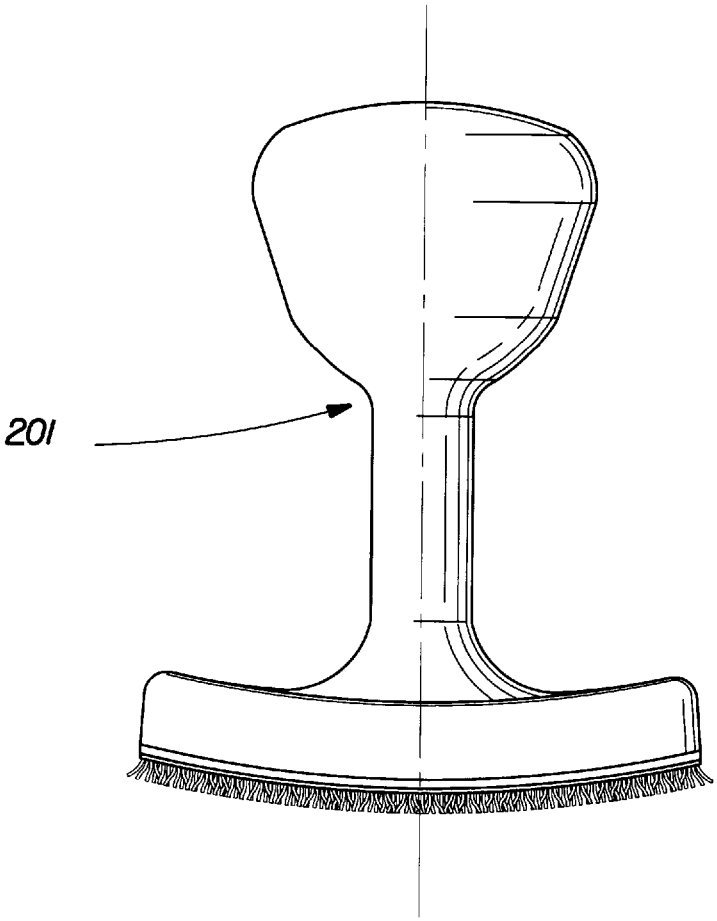
FIG. 2 is a perspective of the assembled arcuate cleaning device (201) used herein to pre-clean localized stains on fabrics.

Cleaning Device—As shown in FIGS. 2 and 13, one style of preferred cleaning device employed in the spot-cleaning process of the present invention has as its base element a cleaning face which is curvilinear, i.e., which is in a generally convex, arcuate configuration. In another embodiment, the device can have a circular, convex base (301), as shown in FIG. 1. Overall, the arcuate device is reminiscent of an old-fashioned, flat-sided, arcuate desk blotting instrument, but with multiple protrusions (as described more fully hereinafter) extending outwardly from its operational face. The arcuate, convex configuration of the treatment face of the device herein provides several advantages over convex, circular cleaning devices. First, the arcuate configuration efficiently and effectively allows downward (Z-directional) force to be applied to the stained areas of the fabric. Second, the arcuate configuration dissuades the user from disadvantageously employing a side-to-side (X–Y directional) rubbing motion with the device. Third, the preferred type of cleaning element, with its plurality of protuberances, is easier to apply and adhere to the arcuate, convex device than to a circular, convex device. This is because the element can be laid-down more readily on the convex surface of the arcuate device and, thus, can more easily be affixed thereto by gluing or other means. Accordingly, the convex, arcuate device herein is superior to the convex, circular device with respect to its ease of manufacture on a commercial scale. However, the circular convex device is also useful herein.

The rear face of the device can be of any configuration, e.g., concave, convex, planar, arched, etc., to provide a means for gripping the device in the hand. In a preferred embodiment, the hand grip comprises a shaft extending outwardly from the rear face of said base member, preferably from the center of the rear face, and most preferably wherein said shaft is substantially perpendicular to the rear face. For ease-of-handling, the distal end of the shaft preferably terminates in a bulb which is of a size that fits in the user's hand.

By employing a hand grip in the form of a shaft which is substantially perpendicular to the operational convex base member, the user is further encouraged to use the device in the desired rocking motion, rather than in a scrubbing motion, which would be unhandy due to the perpendicularity of the shaft relating to the operational arcuate treatment face of the device. Thus, the overall configuration of the device, with its convex base and gripping shaft, immediately encourages proper use of the device. Optionally, simple operating instructions, such as "Rock, Don't Rub" can be affixed to the device as a reminder.

In one additional mode, all or part of the body of the device, including the base and/or the hand grip, can be hollow, thereby providing a cavity which can be used to store multi-use portions of the spot cleaning ("pre-spotting") composition until time-of-use. In this aspect of the invention, the device can be fitted with suitable means of egress for the composition onto the stained areas of the fabric. Thus, holes, channels, or the like, can pass through the base member to provide communication between the storage cavity such that the spot cleaning composition can exit the device at the treatment face, and thence onto the stained area of the fabric being spot-treated. In another mode, the device can be fitted with a suitable orifice from which the composition can be poured, squeezed, dripped, or otherwise dispensed from the device onto the stained area of the fabric.

In one embodiment, the treatment members comprise a multiplicity of protrusions, e.g., bristle-like filaments. Preferably, said treatment members are underlaid by a resilient sponge base which is affixed to the convex face of the arcuate base member. This resilient base also acts as a cushion to buffer the impact of the bristles on the surface of the fabric, thereby further helping to minimize deleterious effects on the fabric surface and more evenly distributing the mechanical forces.

Figure 3:
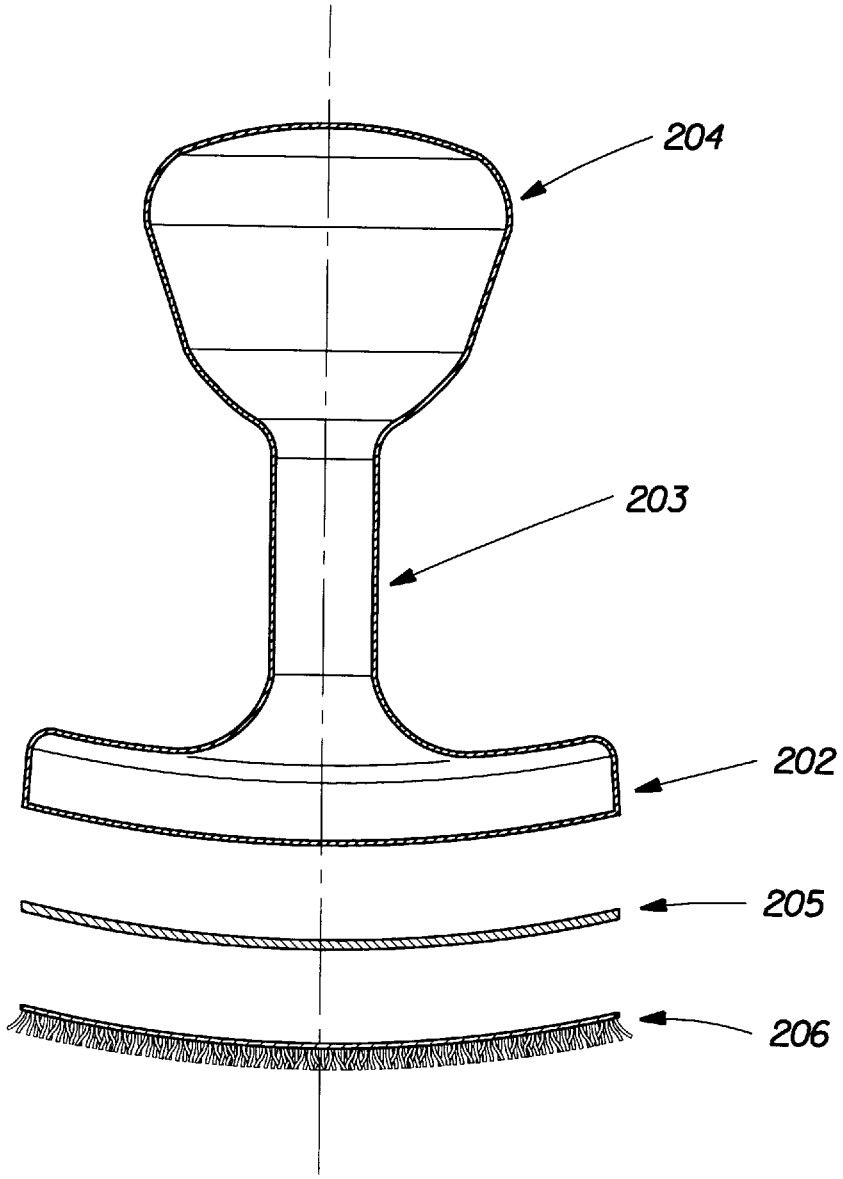
FIG. 3 is an exploded view of the device showing the arcuate base (202), cylindrical shaft (203) and bulb (204)

Device Dimensions—The cleaning device herein can be of any desired size. The device as shown in FIG. 3 is of a size which is convenient for hand-held use. In this embodiment, the length of the arcuate base member (202) with its convex, generally rectangular configuration is about 2.25 inches (57.15 mm); its width is about 1.25 inches (31.75 mm); and its thickness is about 0.625 inch (15.8 mm). The length of the cylindrical shaft (203) extending perpendicularly outward from the rear of the arcuate base to the base of bulb (204) is about 1.4 inches (35.6 mm), and its diameter is about 0.75 inches (19 mm). The bulb (204) which serves as a hand (or palm) rest at the terminal end of the shaft (203) has a circumference at its widest point of about 5.25 inches (133 mm). The combination of shaft and bulb thus comprises the hand grip for the device. The overall height of the device measured from the center of the top of the bulb (204) to the center point of the front face of the convex base is about 2⅞ inches (7.3 cm). The uncompressed thickness of the sponge layer (205) can vary, and is typically about 0.1 inches (2.54 mm). The uncompressed thickness of the layer of filamentous protrusions (206) can likewise vary and is typically about 0.1 inches (2.54 mm). Similar dimensions are typical for the circular, convex device of FIG. 1, whose circular base member (301) has a diameter typically of about 0.75–3 inches (1.91–7.62 cm).

In the preferred embodiment of the arcuate device shown in FIG. 13, the length of the arcuate base member (403) with its convex, generally rectangular configuration is about 2 inches (5 cm); its width is about 1.25 inches (3.2 cm); and its thickness is about 5/16 inch (0.8 cm). The width of shaft (404) at its mid-point is about 1 inch (2.54 cm) and its thickness at its mid-point is about 0.75 inch (1.9 cm). The length of the shaft (404) extending perpendicularly outward from the rear of the arcuate base to the base of bulb (405) is about 1.25 inches (3.2 cm). The bulb (405) which serves as a hand (or palm) rest has a circumference at its widest point of about 5.75 inches (14.6 cm). The combination of shaft and bulb thus comprise the hand grip for the device. The overall height of the device measured from the center of the top of the bulb (405) to the center point of the front face of the convex base is about 3 inches (7.6 cm). The dimensions of the sponge layer (402) and protuberances (401) are as given above.

Spot Removal—The arcuate base, shaft and palm rest of the fabric cleaning devices which are provided by this invention for use in the pre-spotting operation of the overall process herein can be manufactured by injection molding or other suitable processes using polymers such as low- and high-density polyethylene, polypropylene, nylon-6, nylon-6,6, acrylics, acetals, polystyrene, polyvinyl chloride, and the like. High density polyethylene and polypropylene are within this range and are preferred for use herein. Brightener-free materials are preferably used.

The treatment members on the devices herein can comprise natural or synthetic bristles, natural or synthetic sponges, absorbent pads such as cotton, rayon, regenerated cellulose, and the like, as well as the HYDRASPUN® fabric described herein, and combinations thereof. Various useful materials are all well-known in the cleaning arts in conventional brushes and toothbrushes (see U.S. Pat. No. 4,637,660) and in various cleaning utensils. Sponges, pads, and the like can typically have a thickness of from about 1 mm to about 1.25 cm and can be glued to the convex front treatment face of the device. Preferably, the sponges, pads, bristled pads, etc., are brightener-free and are typically co-extensive with substantially the entire treatment face.

The protuberances which project outwardly from the treatment face of the base of the device can be in the form of blunt or rounded bristles, which may be provided uniformly across the entire treatment face or in clusters. The protuberances can be in the form of monofilament loops, which can be circular, ovoid or elongated, or can be cut loops. The protuberances can comprise twisted fiber bundles, extruded nubs, molded finger-like appendages, animal hair, reticulated foams, rugosities molded into the face of the member, and the like. Protuberances made from monofilament fibers may be straight, twisted or kinked. Again, these are preferably brightener-free.

In one embodiment, the treatment member can comprise multiple components. In particular, the treatment member can comprise an absorbent base material which can be, for example, a natural or synthetic sponge, an absorbent cellulosic sheet or pad, or the like. In contact with and extending outward from this base material are multiple protrusions as disclosed above. A specific example of this embodiment is a treatment member comprising multiple looped protuberances made from monofilament fibers which protrude from a sponge base layer. In this embodiment, the absorbent base layer can act as a reservoir which feeds the spot cleaning composition to the protuberances and thence onto the fabrics being treated.

In various optional modes, the treatment members present on the convex face of the device herein can comprise a multi-layer composite comprising a sponge-like, resilient backing material for a fibrous layer having multiple fibrous elements extending outwardly therefrom. Such composites can be permanently or semi-permanently affixed to the treatment members using glue, pressure sensitive adhesives, or other conventional means, and, typically, are also substantially co-extensive with the entire arcuate face of the device. Such composites can be made from conventional materials, e.g., using a sponge, foam or other absorbent base pad material from about 0.5–20 mm thickness and a layer of fibers such as a conventional painter's pad with fibers having a length of from about 0.05 mm to about 20 mm.

The protuberances herein are typically provided as a bed or mat which comprises multiple strands or loops which extend therefrom in the Z-direction. Convenient and familiar sources include pile carpet-type materials, paint pad-type materials, and the like. In such embodiments, the treatment member will comprise several thousand protuberances per $cm^2$. With the looped protuberances, there will typically be 10–500, preferably about 60–150, loops per $cm^2$. The choice of the source, style and number of protuberances are matters for the manufacturer's discretion, and the foregoing illustrations are not intended to be limiting of the invention.

The protuberances should preferably extend outwardly from the face of the treatment member for a distance of at least about 0.1 mm, preferably about 0.1 inches (2.54 mm). While there is no upper limit to their length, there is essentially no functional reason for the protuberances to extend more than about 1.25 cm.

The protuberances can be made from plastic, rubber or any other convenient, resilient material which is stable in the presence of the cleaning composition. Fibrous protrusions can be made from natural or synthetic fibers. Fiber diameters can typically range from 0.1 mil (0.0025 mm) to 20 mil (0.5 mm). Again, this is a matter of selection and is not intended to be limiting.

A preferred embodiment comprises a sponge layer of about 1.5 mm to about 7.0 mm thickness having a plurality of fibrous protrusions extending outwardly therefrom, said protrusions comprising brightener-free nylon 6,6 fibers having a length of about 0.10 inches (2.54 mm) and a denier of about 45+, i.e., about 2.7 mil (ca. 76 micrometers). Such fibers can be adhered to the sponge base using flocking or other techniques.

In another embodiment, the protuberances are in the form of a multiplicity of stiffened, ovoid looped fibers which extend outwardly from the treatment face. Such looped fibers can comprise, for example, 7 mil (0.18 mm) monofilament loops of polypropylene extending at least about 0.03 inch (0.76 mm), typically from about 2.0 mm to about 1.5 cm, outwardly from the face of a backing material. The diameter of the loops at their widest point is about 1.3 mm. A convenient material for said looped protrusions is available commercially from Aplix Inc., Number 200, Unshaved Loop, Part No. DM32M000-QY. This material comprises a nylon backing with about 420 loops per square inch (65 loops per $cm^2$) extending from its surface.

It will be appreciated that the devices herein can be made from a variety of plastic, glass, wood, etc. materials and with various overall shapes, decorations and the like, according to the desires of the manufacturer. If desired, the device can be prepared from transparent or translucent materials. This can be helpful under circumstances where the device is hollow and provides a reservoir for the pre-spotting composition, since the user can visually judge the "fill" level. Of course, the devices are preferably made from materials which will not be affected by the various ingredients used in the cleaning compositions. The size of the devices is entirely optional. It is contemplated that rather large devices (e.g. 200–1000 $cm^2$ convex treatment face) would be suitable for mounting and use in a commercial cleaning establishment. In the home, the device is intended for hand-held use, and its dimensions are generally somewhat smaller. Typically, the surface area of the convex treatment face for home use will be in the range of from about 4 $cm^2$ to about 200 $cm^2$. This is variable, according to the desires of the manufacturer.

While the surface area of the treatment members can be adjusted according to the desires of the manufacturer, it is convenient for a hand-held, home-use device to have a treatment face whose surface area is in the range from about 5 $cm^2$ to about 70 $cm^2$.

Stain Receiver—A stain receiver can optionally be used in the pre-spotting operation herein. Such stain receiver can be any absorbent material which imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area. A preferred receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils (1.524 mm) thick. It optionally, but preferably, has a barrier film on its rear surface to prevent the cleaning liquid from passing onto the surface on which the pre-spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer. The lower capillary suction comes from having greater synthetic staple fiber content in the upper layer (these fibers have surfaces with higher contact angles, and correspondingly lower affinity for water, than wood pulp fibers) than in the lower layer.

More particularly, the absorbent stain receiver article herein can be conveniently manufactured using procedures known in the art for manufacturing nonwoven, thermally bonded air laid structures ("TBAL"). As an overall proposition, TBAL manufacturing processes typically comprise laying-down a web of absorbent fibers, such as relatively short (4–5 mm) wood pulp fibers, in which are commingled relatively long (30–50 mm) bi-component fibers which melt slightly with the application of heat to achieve thermal bonding. The bi-component fibers intermingled throughout the wood pulp fibers thereby act to "glue" the entire mat together. Different from conventional TBAL-type structures, the disposition of the bi-component fibers in the upper and lower layers of the stain receiver herein is not uniform. Rather, the upper (fluid receiving) layer of the fibers which comprises the stain receiver is relatively richer in bi-component fibers than in wood pulp (or other cellulosic) fibers. Since the bi-component fibers are made from synthetic polymers which are relatively hydrophobic, the upper layer of fibers in the stain receiver tends to be more hydrophobic, as compared with the lower layer of fibers which, since it contains a high proportion of wood pulp, tends to be more hydrophilic. This difference in hydrophobicity/hydrophilicity between the upper and lower fiber layers in the stain receiver helps draw water (e.g., the aqueous compositions herein) and stain materials out of the fabrics which are being treated in the manner disclosed herein.

To illustrate the foregoing in more detail, in one mode, the present stain receiver the uppermost (fluid receiving) layer (to be placed against the soiled garment) is about 50% bicomponent fiber and about 50% wood pulp, by weight, with a basis weight of about 50 grams/$m^2$ (gsm). The lower layer is an 80/20 (wt.) blend of wood pulp and bicomponent staple fiber with a basis weight of about 150 gsm. These ratios can be varied, as long as the upper layer is more hydrophobic than the lower layer. For example, upper layers of 60/40, 70/30, etc. bicomponent/wood can be used. Lower layers of 90/10, 65/35, 70/30, etc. wood/bicomponent can be used.

Lint Control Binder Spray—A heat crosslinkable latex binder can optionally be sprayed onto the upper layer of the stain receiver article to help control lint and to increase strength. A variety of alternative resins may be used for this purpose. Thus, the surface of the uppermost layer can be sprayed with a crosslinkable latex binder (Airflex 124, supplied by Air Products) at a concentration of about 3 to 6 grams per square meter. This binder does not have great affinity for water relative to wood pulp, and thus does not importantly affect the relative hydrophobicity of the upper layer. Cold or hot crimping, sonic bonding, heat bonding and/or stitching may also be used along all edges of the receiver to further reduce linting tendency.

Backing Sheet—When thus prepared, the bi-layer absorbent structure which comprises the stain receiver is sufficiently robust that it can be used as-is. However, in order to prevent strike-through of the liquid onto the table top or other treatment surface selected by the user, it is preferred to affix a fluid-impermeable barrier sheet to the bottom-most surface of the lower layer. This backing sheet also improves the integrity of the overall stain receiver article. The bottom-most surface of the lower layer can be extrusion coated with an 0.5–2.0 mil (0.013 mm–0.05 mm), preferably 0.75 mil (0.019 mm), layer of PE or PP film using conventional procedures. The film layer is designed to be a pinhole-free barrier to prevent any undesired leakage of the liquid composition beyond the receiver. This backing sheet can be printed with usage instructions, embossed and/or decorated, according to the desires of the formulator. The stain receiver is intended for use outside the dryer. However, since the receiver may inadvertently be placed in the dryer and subjected to high temperatures, it is preferred that the backing sheet be made of a heat resistant film such as polypropylene or nylon.

Basis weight—This can vary depending on the amount of cleaning/refreshment solution provided/anticipated to be absorbed. The preferred stain receiver structure exhibits a horizontal absorbency of about 4–15 grams of water for every gram of nonwoven. A typical 90 mm×140 mm receiver absorbs about 10–20 grams of water. Since very little fluid is used in the typical stain removal process, much less capacity is actually required. A practical basis weight range is therefore about 10 g. to about 50 g.

Size—The size of the preferred receiver is about 90 mm by 140 mm, but other sizes can be used. The shape can be varied.

Fibers—Conveniently available 2–3 denier (0.0075–0.021 mm) polyethylene/polypropylene PE/PP bicomponent staple and standard wood pulp (hammermilled) fibers are used in constructing the preferred receiver. Other common staple fibers such as polyester, acrylic, nylon, and bicomponents of these can be employed as the synthetic component. Again, capillary suction requirements need to be considered when selecting these fibers and their sizes or deniers. Larger denier detracts from capillary suction as does surface hydrophobicity. The absorbent wood pulp fiber can also be substituted with cotton, hemp, rayon, and others. If desired, the lower layer can also comprise the so-called "supersorber" absorbent gelling materials (AGM) which are known for use in the diaper and catamenial arts. Such AGM's can comprise 1% to 20%, by weight, of the lower layer.

Thickness—The overall thickness (measured unrestrained) of the stain receiver is about 60 mils. (1.524 mm), but can be varied widely. The low end may be limited by the desire to provide absorbency impression. 25 mils to 200 mils (0.6 mm–5.1 mm) is a reasonable range.

Capillary suction/density—The overall density of the stain receiver affects both absorbency rate and fluid capacity. Typical wood pulp containing absorbent articles have a density (measured unrestrained) that ranges around 0.12–0.15 g/cc+/–0.05. The preferred bi-layer stain receiver herein also has a density in the same range, but can be adjusted outside this range. Higher density increases stiffness; lower density decreases overall strength and makes linting more probable. The capillary suction is determined by the type of fibers, the size of the fibers, and the density of the structure. Fabrics come in many varieties, and will exhibit a large range of capillary suction, themselves. It is desirable to construct a receiver that has a greater surface capillary suction than that of the stained garment being treated.

Colors—White is the preferred color, as it will best show stains as they are being removed from the fabrics being treated. However, there is no other functional limit to the color.

Embossing—The preferred stain receiver structure is embossable with any desired pattern or logo.

Optional Nonwoven (NW) types—While the TBAL stain receiver structure is preferred to permit density control, good thickness perception, good absorbency, and good resiliency, other types of NWs that can reasonably be used are hydroentangled, carded thermal, calendar-bonded, and other good wipe substrate-making processes (including thermal bonded wet-laid, and others).

Manufacture—The manufacture of the preferred bi-layer stain receiver is conducted using conventional TBAL processes. In one mode, the lower wood fiber-rich layer is first laid-down and the upper, synthetic fiber-rich layer is laid-down on top of it. The optional binder spray is applied to the upper layer at any convenient time. The resulting bi-layer structure is collected in rolls (which compacts the overall structure somewhat). Overall, the bi-layer structure (unrestrained) has a thickness of about 60 mils (1.524 mm) and a density of about 0.13–0.15 g/cc. This density may vary slightly, depending on the usage rates of the binder spray. The optional backing sheet is applied by passing the structure in sheet form through nip-rollers, together with a sheet of the backing film. Again, conventional procedures are used. If desired, and as a cost savings, the relative thicknesses of the lower and upper layers can be varied. Thus, since wood pulp is less expensive than bi-component fibers, the manufacturer may decide to lay down a relatively thicker lower layer, and a relatively thinner upper layer. Thus, rather than a structure whose upper/lower layer thickness ratio is about 1:1, one can select ranges of 0.2:1, 0.3:1, 0.5:1, and the like. If more absorbency is required, the ratios can be reversed. Such considerations are within the discretion of the manufacturer.

The bi-layer stain receiver is intended to be made so inexpensively that it can be discarded after a single use. However, the structures are sufficiently robust that multiple re-uses are possible. In any event, the user should position the article such that "clean" areas are positioned under the stained areas of the fabric being treated in order to avoid release of old stains from the stain receiver back onto the fabric.

Another type of stain receiver for use herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

For pre-spotting, the stained area of the garment or fabric swatch is placed over and in close contact with a section of FAM, followed by treatment with an aqueous or non-aqueous cleaning solution in conjunction with the use of the cleaning device herein to provide mechanical agitation. Repeated rocking with the device and the detergency effect of the solution serve to loosen the soil and transfer it to the FAM. While spot cleaning progresses, the suction effects of the FAM capillaries cause the cleaning solution and stain debris to be carried into the FAM, where the stain debris is largely retained. At the end of this step the stain as well as almost all of the cleaning solution is found to have been removed from the fabric being treated and transferred to the FAM. This leaves the fabric surface only damp, with a minimum residue of the cleaning solution/stain debris which can lead to undesirable rings on the fabrics.

The manufacture of FAM-type foams for use as the stain receiver herein forms no part of the present invention. The manufacture of FAM foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,268,224 to DesMarais, Stone, Thompson, Young, LaVon and Dyer, issued Dec. 7, 1993; U.S. Pat. No. 5,147,345 to Young, LaVon and Taylor, issued Sep. 15, 1992 and companion patent U.S. Pat. No. 5,318,554 issued Jun. 7, 1994; U.S. Pat. No. 5,149,720 to DesMarais, Dick and Shiveley, issued Sep. 22, 1992 and companion patents U.S. Pat. No. 5,198,472, issued Mar. 30, 1993 and U.S. Pat. No. 5,250,576 issued Oct. 5, 1993; U.S. Pat. No. 5,352,711 to DesMarais, issued Oct. 4, 1994; PCT application 93/04115 published Mar. 4, 1993, and U.S. Pat. No. 5,292,777 to DesMarais and Stone, issued Mar. 8, 1994; U.S. Pat. No. 5,387,207 to Dyer, DesMarais, LaVon, Stone, Taylor and Young, issued Feb. 7, 1995; U.S. Pat. No. 5,500,451 to Goldman and Scheibel, issued Mar. 19, 1996; U.S. Pat. No. 5,550,167 to DesMarais, issued Aug. 27, 1996.

As noted above for the TBAL stain receiver, the FAM-type stain receiver can also be provided with a backing sheet on its bottom-most surface to improve its integrity and to help prevent fluid strike-through.

While the compositions and processes of the present invention can be employed under any circumstances where fabric cleaning/refreshment is desired, they are especially useful in a non-immersion home "dry" cleaning/fabric refreshment process, as is described in more detail hereinafter.

Containment Bag—It has now been discovered that high water content compositions can be loaded onto a carrier substrate such as a cloth or woven or non-woven towelette and placed in a bag environment in a heated operating clothes dryer, or the like, to remove malodors from fabrics as a dry cleaning alternative or "fabric refreshment" process. The warm, humid environment created inside this bag volatilize malodor components in the manner of a "steam distillation" process, and moistens fabrics and the soils thereon. This moistening of fabrics can loosen pre-set wrinkles, but it has now been discovered that overly wet fabrics can experience setting of new wrinkles during the drying stage toward the end of the dryer cycle. Proper selection of the amount of water used in the process and, importantly, proper venting of the bag in the present manner can minimize wrinkling. Moreover, if the bag is not vented, the volatilized malodorous materials removed from the fabrics can undesirably be re-deposited thereon. Alternatively, however, if fabric wrinkling is not of concern, a sealed bag can be employed.

The present invention thus preferably employs a vapor-venting containment bag which is intended for use in a fabric cleaning/refreshment operation. The bag is preferably designed for multiple uses and reuses, and is especially adapted for use by the consumer in any conventional hot air clothes dryer apparatus, such as those found in the home or in commercial laundry/cleaning establishments. The bag herein is specifically designed to vent water and other vapors which emanate from within the bag when used in the manner described herein. The vapors released from the bag are thence exhausted through the air vent of the dryer apparatus.

As described more fully hereinafter, the bag is provided with a vapor-venting closure which provides one or more gaps through which vapors are released from the bag, in-use. In a preferred embodiment, the size of this gap is selected to provide controlled vapor release from the bag under the indicated operating conditions. While other gap sizes and operating conditions can be used, a preferred balance between vapor containment within the bag to perform the cleaning/refreshment function and vapor release from the bag has now been determined using the principles disclosed hereinafter.

Alternatively, the bag can be provided with a series of holes or other fenestrations which provide vapor venting. However, such venting is not as effective as the vapor-venting closure.

In one embodiment, the present invention encompasses a vapor-venting containment bag comprising an open end, a closed end and flexible side walls having inner and outer surfaces, the open end of said bag having a section of one side wall extending beyond said open end to provide a flexible flap, said flap having first fastening device affixed thereto, said flap being foldable to extend over a portion of the outside surface of the opposing side wall, said flap being affixable to the outer surface of the opposing wall of the bag by engaging said first fastening device on the inside face of the flap with a second fastening device present on the outside face of said opposing side wall, said first and second fastening devices, when thus engaged, forming a fastener, thereby providing a closure for the open end of the bag. Said first and second fastening devices are disposed so as, when engaged, to provide vapor-venting along said closure, especially at the lateral edges of the closure. The bag herein is most preferably formed from film which is heat resistant up to at least about 204° C.–260° C. Nylon is a preferred film material for forming the bag. In another embodiment, the edge of the wall of the bag is notched along a substantial portion of its width to facilitate and optimize vapor venting.

In an alternate mode, the flap can be folded to provide the closure and tucked inside the opposing side wall, and is secured there by a fastener. In this mode, vapors are vented along the closure and especially at the lateral edges of the closure. In yet another mode, the side walls are of the same size and no flap is provided. Fastening devices placed along a portion of the inner surfaces of the side walls are engaged when the lips of the side walls are pressed together to provide closure. One or more vapor-venting gaps are formed in those regions of the closure where no fastening device is present.

While the fastening devices herein can comprise chemical adhesives, the bag is preferably designed for multiple uses. Accordingly; reusable mechanical fasteners are preferred for use herein. Any reusable mechanical fastener or fastening means can be used, as long as the elements of the fastener can be arranged so that, when the bag is closed and the fastener is engaged, a vapor-venting closure is provided. Non-limiting examples include: bags wherein said first and second fastening devices, together, comprise a hook and loop (VELCRO®-type) fastener; bags wherein said first and second fastening devices, together, comprise a hook and string type fastener; bags wherein said first and second fastener devices, together, comprise an adhesive fastener; bags wherein said first and second fastening devices, together, comprise a toggle-type fastener; bags wherein said first and second fastwing devices, together, form a snap-type fastener; as well as hook and eye fasteners, ZIP LOK®-style fasteners, zipper-type fasteners, and the like, so long as the fasteners are situated so that vapor venting is achieved. Other fasteners can be employed, so long as the vapor-venting is maintained when the bag is closed, and the fastener is sufficiently robust that the flap does not open as the bag and its contents are being tumbled in the clothes dryer. The fastening devices can be situated that the multiple vapor-venting gaps are formed along the closure, or at the lateral edges, or so that the gap is offset to one end of the closure. In yet another embodiment, both ends of the bag are provided with a vapor venting closure. This type of bag is referred to in FIGS. 10, 11, 12 as "Envelope Bag (2)".

Preferred bags of the foregoing type which are designed for use in a conventional U.S.-style automatic, in-home hot air clothes dryer will have a volume in the range from about 10,000 $cm^3$ to about 25,000 $cm^3$.

The invention also employs a process for cleaning or refreshing fabrics by contacting said fabrics with a fabric cleaning/refreshing composition comprising water in the aforesaid vapor-venting containment bag. This process is conveniently carried out in a hot air clothes dryer at a dryer operating temperature from about 40° C. to about 150° C., whereby malodors present on said fabrics are vented from the bag by means of the vapor-venting closure.

The design of the venting ability of the bag achieves a proper balance of the above effects. A tightly-sealed, vapor impermeable "closed" bag will not purge malodors and will overly moisten the fabrics, resulting in wrinkling. An overly "open" bag design will not sufficiently moisten the fabrics or soils to mobilize heavier malodors or to remove pre-existing fabric wrinkles. Further, the bag must be "closed" enough to billow and create a void volume under water vapor pressure, wherein the fabrics can tumble freely within the bag and be exposed to the vapors.

The bag must be designed with sufficient venting to trap a portion of water vapors (especially early in the dryer cycle) but to allow most of the water to escape by the end of the cycle. Said another way, the rate of vapor release is, preferably, optimized to secure a balance of vapor venting and vapor trapping. A preferred bag design employs a water vapor impermeable film such as nylon, with a the closure flap (preferably with a hook-and-loop VELCRO®-type fastener) like that of a large envelope. The degree of slack in the fold-over portion of the closure flap can be varied to provide a vapor-venting air gap or partial opening which controls the rate of vapor venting from of the bag. In another mode, a notch is cut along the edge of the side wall opposite the flap to further adjust the venting. The fastener devices shown in the Figures run only partly along the closure, thereby allowing venting to also occur at the lateral edges of the closure.

As can be seen from FIG. 12, the objective herein is to operate within the region of Unwrinkled/Wrinkles Removed on the graph. This region can vary with fabric type. However, as an overall proposition, conducting the process in the manner disclosed herein results in minimizing the formation of new wrinkles and removing wrinkles which are already present in the garments prior to treatment. Moreover, with respect to malodor, it is preferred to deliver sufficient water (grams of water on substrate) to achieve substantial malodor removal. In practice, this means that the operation with the vented bag herein is conducted under conditions towards the right-hand portion of the curve, i.e., in the range between about 15.2 to about 31 grams of liquid cleaning/refreshment composition. Referring to the graph, less liquid can be used, but wrinkles will not be efficiently removed from the fabrics and malodor removal will suffer. Too much liquid, e.g., about 38 grams on this graph, for a bag with 60% venting (60 Vapor Venting Equilibrium as described hereinafter) will cause wrinkles to begin to form in the fabrics. A bag of higher VVE can operate in the ideal range at higher moisture levels (e.g., "Envelope Bag 2"). With regard to these considerations, it has been observed that the carrier substrate used should not be so saturated with the liquid compositions herein that it is "dripping" wet. If excessively wet ("dripping"), localized water transfer to the fabrics being cleaned and refreshed can cause wrinkling. While it might have been thought that a larger carrier substrate could be used to provide more liquid capacity, this can be self-limiting. Carrier sheets which are too large can become entangled with the fabrics being cleaned/refreshed, again resulting in excessive localized wetting of the fabrics. Accordingly, while the carrier sheets used herein are optimal for bag and dryer sizes as noted, their sizes can, without undue experimentation, be adjusted proportionately for larger and smaller bag and/or dryer drum capacities.

The fabrics, when removed from the bag, will usually contain a certain amount of moisture. This will vary by fabric type. For example, silk treated in the optimal range shown on the graph may contain from about 0.5% to about 2.5%, by weight, of moisture. Wool may contain from up to about 4%, by weight, of moisture. Rayon also may contain up to about 4% moisture. This is not to say that the fabrics are, necessarily, frankly "damp" to the touch. Rather, the fabrics may feel cool, or cool-damp due to evaporative water losses. The fabrics thus secured may be hung to further air dry, thereby preventing wrinkles from being re-established. If desired, the fabrics can be ironed or subjected to other finishing processes, according to the desires of the user.

The following is intended to assist the formulator in the manufacture and use of vapor-venting bags in the manner of this invention, but is not intended to be limiting thereof.

Bag Dimensions—FIG. 7 shows the overall dimensions of a notched bag: i.e., length (7) to fold line 27⅝ inches (70.2 cm); width (8) of bag 26 inches (66 cm), with a flap to the base of the fold line (11) of 2⅜ inches (6 cm). In the Tests reported hereinafter, this bag is referred to by its open dimensions as "26 in.×30 in." (66.04 cm×76.20 cm).

FIG. 8 gives additional details of the positioning of the various elements of the notched bag. In this embodiment, all dimensions are the same for both the left hand and right hand sides of the bag. The dimensions herein are for an opened bag which is about 30 inches (76.2 cm) in overall length (including the flap) and about 26 inches (66 cm) wide. The distance (9) from the lateral edge of the bag to the outermost edge of the fastening device (3) located on the inside of the flap (5) is about 2 inches (5 cm). In this embodiment, the fastening device (3) on the inside of wall **(2*a*) comprises the loop portion of a VELCRO®-type strip whose width (13) is about 0.75 inches (1.9 cm) and whose total length is about 22 inches (55.9 cm). Fastening device (6) is similarly situated on the outside of wall 2(*b*) and comprises the hook portion of a ¾ inch (1.9 cm) VELCRO®-type strip. Distance (9) can be decreased or increased to decrease or increase venting at the edges of the flap when the bag is closed and the fastener is engaged. The distance (10) between the uppermost edge of the flap and the base of the notch is about 2⅞ inches (7.3 cm). The distance (14) between the lateral edge of the bag and the lateral edge of the notch is about 0.25 inches (0.64 cm). The distance (15) between the uppermost edge of the flap and the fold (11) is about 2⅜ inches (6 cm). The distance (16) between the uppermost edge of the flap and the leading edge of the VELCRO®-type strip (3) affixed to the flap is about ⅜ inches (0.95 cm). The distance (17) between fold (11) and the lowermost edge of the notch is about ½ inch (1.27 cm). This distance also can be varied to decrease or increase vapor venting. A range of 0.25–1.5 inches (0.64–3.81 cm) is typical. The distance (18) between the uppermost edge of the VELCRO®-type strip (6) and the bottom edge of the notch is about ¾ inches (1.9 cm). The distance (19) between the bottommost edge of the VELCRO®-type strip (3) and the fold (11)** is about 1¼ inches (3.17 cm).

FIG. 9 gives additional details of the dimensions of an un-notched envelope bag of the foregoing overall size comprising sidewalls **(2*a*) and (2*b*). Again, each VELCRO®-type strip (3) and (6) is about ¾ inches (1.9 cm) in width and about 22 inches (55.9 cm) in length. Each strip is positioned so as to be inboard from each of the lateral edges of the finished bag wall and flap by about 2 inches (5 cm). The distance (12) between the leading edge of the sidewall (2*b*) to the base edge of the fastener strip (3) on the flap portion of the bag is about 2½ inches (6.35 cm). The distance (20) between the base edge of the fastener strip (6) to the leading edge of the sidewall (2*b*) is about 2.25 inches (5.7 cm). The distance (21) between the leading edge of the fastener strip (6) to the leading edge of the sidewall is about 1⅜ inches (3.5 cm). The distance (22) between fold (11) and the base edge of the fastener strip (3) is about 2 inches (5 cm). The distance (23) between the leading edge of fastener strip (3) and the uppermost edge of the flap which is an extension of sidewall (2*a*) is about 0.25 inches (0.64 cm). Distance (24)** is about 3⅝ inches (9.2 cm). As in the foregoing notched bag, the positioning and length of the fasteners can be adjusted to decrease or increase venting.

The construction of the preferred, heat-resistant vapor-venting bag used herein to contain the fabrics in a hot air laundry dryer or similar device preferably employs thermal resistant films to provide the needed temperature resistance to internal self-sealing and external surface deformation sometimes caused by overheated clothes dryers. In addition, the bags are resistant to the chemical agents used in the cleaning or refreshment compositions herein. By proper selection of bag material, unacceptable results such as bag melting, melted holes in bags, and sealing of bag wall-to-wall are avoided. In a preferred mode, the fastener is also constructed of a thermal resistant material. As shown in FIGS. 7 and 9, in one embodiment, 1 to 3 mil (0.025–0.076 mm) heat-resistant Nylon-6 film is folded and sealed into a containment bag. Sealing can be done using standard impulse heating equipment. In an alternate mode, a sheet of nylon is simply folded in half and sealed along two of its edges. In yet another mode, bags can be made by air blowing operations. The method of assembling the bags can be varied, depending on the equipment available to the manufacturer and is not critical to the practice of the invention.

The dimensions of the containment bag can vary, depending on the intended end-use. For example, a relatively smaller bag can be provided which is sufficient to contain one or two silk blouses. Alternatively, a larger bag suitable for handling a man's suit can be provided. Typically, the bags herein will have an internal volume of from about 10,000 $cm^3$ to about 25,000 $cm^3$. Bags in this size range are sufficient to accommodate a reasonable load of fabrics (e.g., 0.2–5 kg) without being so large as to block dryer vents in most U.S.-style home dryers. Somewhat smaller bags may be used in relatively smaller European and Japanese dryers.

The bag herein is preferably flexible, yet is preferably durable enough to withstand multiple uses. The bag also preferably has sufficient stiffness that it can billow, in-use, thereby allowing its contents to tumble freely within the bag during use. Typically, such bags are prepared from 0.025 mm to 0.076 mm (1–3 mil) thickness polymer sheets. If more rigidity in the bag is desired, somewhat thicker sheets can be used.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C). Under circumstances where excessive heating is not of concern, the bag can be made of polyester, polypropylene or any convenient polymer material.

Vapor Venting Evaluation—In its broadest sense, the preferred vapor-venting containment bag used in this invention is designed to be able to vent at least about 40%, preferably at least about 60%, up to about 90%, preferably no more than about 80%, by weight, of the total moisture introduced into the bag within the operating cycle of the clothes dryer or other hot air apparatus used in the process herein. (Of course most, if not all, of organic cleaning solvents, if any, will also be vented during together with the water. However, since water comprises by far the major portion of the cleaning/refreshment compositions herein, it is more convenient to measure and report the venting as water vapor venting.)

It will be appreciated by those knowledgeable about the operation of hot air clothes dryers and similar apparatus that the rate of venting will usually not be constant over the entire operating cycle. All dryers have a warm-up period at the beginning of the operating cycle, and this can vary according to the specifications of the manufacturer. Most dryers have a cool-down period at the end of the operating cycle. Some venting from the containment bag can occur during these warm-up and cool-down periods, but its rate is generally less than the venting rate over the main period of the drying cycle. Moreover, even during the main period of the cycle, many modern dryers are constructed with thermostat settings which cause the air temperature in the dryer to be increased and decreased periodically, thereby preventing overheating. Thus, an average, rather than constant, dryer operating temperature in the target range of from about 50° C. to about 85° C. is typically achieved.

Moreover, the user of the present containment bag may choose to stop the operation of the drying apparatus before the cycle has been completed. Some users may wish to secure fabrics which are still slightly damp so that they can be readily ironed, hung up to dry, or subjected to other finishing operations.

Apart from the time period employed, the Vapor-Venting Equilibrium ("VVE") for any given type of vapor-venting closure will depend mainly on the temperature achieved within the dryer—which, as noted above, is typically reported as an average "dryer air temperature". In point of fact, the temperature reached within the containment bag is more significant in this respect, but can be difficult to measure with accuracy. Since the heat transmittal through the walls of the bag is rather efficient due to the thinness of the walls and the tumbling action afforded by conventional clothes dryers, it is a reasonable approximation to measure the VVE with reference to the average dryer air temperature.

Moreover, it will be appreciated that the vapor-venting from the containment bag should not be so rapid that the aqueous cleaning/refreshment composition does not have the opportunity to moisten the fabrics being treated and to mobilize and remove the soils/malodors therefrom. However, this is not of practical concern herein, inasmuch as the delivery of the composition from its carrier substrate onto the fabrics afforded by the tumbling action of the apparatus occurs at such a rate that premature loss of the composition by premature vaporization and venting is not a significant factor. Indeed, the preferred bag herein is designed to prevent such premature venting, thereby allowing the liquid and vapors of the cleaning/refreshment composition to remain within the bag for a period which is sufficiently long to perform its intended functions on the fabrics being treated.

The following Vapor-Venting Evaluation Test (VVET) illustrates the foregoing points in more detail. Larger or smaller containment bags can be used, depending on the volume of the dryer drum, the size of the fabric load, and the like. As noted above, however, in each instance the containment bag is designed to achieve a degree of venting, or VVE "score", of at least about 40% (40 VVE), preferably at least about 60% (60 VVE), up to about 90% (90 VVE). A preferred VVE range is about 50 to about 90, more preferably about 60 to about 80, with about 70 being close to the optimum for the envelope bag.

VAPOR-VENTING EVALUATION TEST

Materials:

Envelope or "Standard", i.e., Control Containment Bag to be evaluated for VVE.

Carrier Substrate (15"×11"; 38.1 cm×27.9 cm) HYDRASPUN® carrier substrate sheet from Dexter with (10444) or without (10244) Binder Wool Blouse: RN77390, Style 12288, Weight approx. 224 grams Silk Blouse: RN40787, Style 0161, Weight approx. 81 grams Rayon Swatch: 45"×17" (114.3 cm×43.2 cm), Weight approx. 60 grams Pouch: 5"×6.375" (12.7 cm×16.2 cm) to contain the Carrier Substrate and water De-ionized Water; Weight is variable to establish VVE.

Pretreatment of Fabrics:

1. The wool, silk, and rayon materials are placed in a Whirlpool dryer (Model LEC7646DQO) for 10 minutes at high heat setting, with the heating cycle ranging from about 140° F.–165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure:

1. Water of various measured weights from 0 to about 40 grams is applied to the carrier substrate a minimum of 30 minutes before running a vented bag test. The substrate is folded, placed in a pouch and sealed.
2. Each fabric is weighed separately and the dry weights are recorded. Weights are also recorded for the dry carrier substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the carrier substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the carrier substrate.
7. The remaining unmeasured moisture divided by the total moisture is recorded as percent vented from the dryer bag.
8. When a series of total applied moisture levels are evaluated, it is seen that above about 15–20 grams of water the % vented becomes essentially constant, and this is the Vapor-Venting Equilibrium value, or VVE, for the particular bag venting design.

It can be seen from examining a series of VVET results at various initial moisture levels that the water at lower initial levels is being disproportionately captured by the garment load, the headspace, and the nylon bag, such that venting of water and volatile malodors begins in earnest only after the VVE value is achieved. Since this occurs only when about 15–20 grams or more of water is initially charged, it is seen that a VVE of greater than about 40 is needed to avoid excessive wetting of garments, leading to unacceptable wet-setting of wrinkles, as discussed herein.

Malodor and Wrinkle Removal

The overall process comprises the spot removal step which employs the arcuate cleaning device of this invention on isolated, stained areas of the fabric. Following this stain removal step, the entire fabric can be cleaned/refreshed in a step which is preferably conducted in the vapor-venting containment bag. This latter step provides a marked improvement in the overall appearance and refreshment of fabrics, especially with respect to the near absence of malodors and wrinkles, as compared with untreated fabrics.

One assessment of this step of the process herein with respect to malodors comprises exposing the fabrics to be tested to an atmosphere which contains substantial amounts of cigarette smoke. In an alternate mode, or in conjunction with the smoke, the fabrics can be exposed to the chemical components of synthetic perspiration, such as the composition available from IFF, Inc. Expert olfactory panelists are then used to judge odor on any convenient scale. For example, a scale of 0 (no detectable odor) to 10 (heavy malodor) can be established and used for grading purposes. The establishment of such tests is a matter of routine, and various other protocols can be devised according to the desires of the formulator.

For example, garments to be "smoked" are hung on clothing hangers in a fume hood where air flow has been turned off and vents blocked. Six cigarettes with filters removed are lighted and set in ashtrays below the garments. The hood is closed and left until the cigarettes have about half burned. The garments are then turned 180° to get even distribution of smoke on all surfaces. Smoking is then continued until all cigarettes are consumed. The garments are then enclosed in sealed plastic bags and allowed to sit overnight.

After aging for about one day, the garments are treated in the cleaning/refreshment process using the venting bag. The garments are removed promptly from the containment bag when the dryer cycle is finished, and are graded for malodor intensity. The grading is done by an expert panel, usually two, of trained odor and perfume graders. The malodor intensity is given a grade of 0 to 10, where 10 is full initial intensity and 0 is no malodor detected. A grade of 1 is a trace detection of malodor, and this grade is regarded as acceptably low malodor to most users.

In the absence of perfume ingredients in the cleaning cloth composition, the grading of residual malodor intensity is a direct indication of degree of cleaning or removal of malodorous chemicals. When perfumed compositions are used, the grading panelists can also determine a score for perfume intensity and character (again on a 0 to 10 scale), and the malodor intensity grading in this case would indicate the ability of the residual perfume to cover any remaining malodorous chemicals, as well as their reduction or removal.

After the garment odor grading taken promptly after the cleaning/refreshment process, the garments are hung in an open room for one hour and graded again. This one-hour reading allows for an end-effect evaluation that would follow cool-down by the garments and drying of the moisture gained in the dryer cycle treatment. The initial out-of-bag grading does reflect damp-cloth odors and a higher intensity of warm volatiles from the bag, and these are not factors in the one-hour grades. Further garment grading can be done at 24 hours and, optionally, at selected later times, as test needs dictate.

Likewise, fabric wrinkles can be visually assessed by skilled graders. For example, silk fabric, which wrinkles rather easily, can be used to visually assess the degree of wrinkle-removal achieved by the present processes using the vapor-venting bag. Other single or multiple fabrics can optionally be used. A laboratory test is as follows.

DE-WRINKLING TEST

MATERIALS:

As above for VVET.

De-ionized Water, Weight range (0–38 grams)

Pretreatment of Fabrics:

The silk fabric is placed in a hamper, basket, or drum to simulate normal conditions that are observed after wearing. These storage conditions produce garments that are severely wrinkled (well defined creases) and require a moist environment to relax the wrinkles.

TEST PROCEDURE:

1. One silk fabric is placed in a containment bag being tested.
2. Water (0–38 grams) is applied to the carrier substrate a minimum of 30 minutes before running the test, placed in a pouch and sealed.
3. The silk garment is placed in the test containment bag along with the water-containing substrate (removed from its pouch and unfolded).
4. The bag is closed and placed in a Whirlpool Dryer (Model LEC7646DQO) for 30 minutes at high heat (48°–74° C. cycle).

5. At the end of 30 minutes, the dryer bag is removed from the dryer IMMEDIATELY and the silk garment is placed on a hanger.
6. The silk garment is then visually graded versus the Control Garment from the same Pretreatment Of Fabrics.

In laboratory tests of the foregoing type, the in-dryer, non-immersion cleaning/refreshment processes herein typically provide malodor (cigarette smoke and/or perspiration) malodor grades in the 0–1 range for smoke and somewhat higher for perspiration malodors, thereby indicating good removal of malodor components other than those of sufficiently high molecular weights that they do not readily "steam vaporize" from the fabrics. Likewise, fabrics (silks) have wrinkles removed to a sufficient extent that they are judged to be reasonably suitable for wearing with little, or no, ironing.

Perfume—As noted above, the higher molecular weight, high boiling point, malodorous chemicals tend to be retained on the fabrics, at least to some degree. These malodors can be overcome, or "masked", by perfumes. However, it will be appreciated from the foregoing that the perfumer should select at least some perfume chemicals which are sufficiently high boiling that they are not entirely vented from the bag along with volatile malodors. A wide variety of aldehydes, ketones, esters, acetals, and the like, perfumery chemicals which have boiling points above about 50° C., preferably above about 85° C., are known. Such ingredients can be delivered by means of the carrier substrate herein to permeate the contents of the containment bag during the processes herein, thereby further reducing the user's perception of malodors. Non-limiting examples of perfume materials with relatively high boiling components include various essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin and lavender. Still other perfume chemicals include phenyl ethyl alcohol, terpineol and mixed pine oil terpenes, linalool, linalyl acetate, geraniol, nerol, 2-(1,1-dimethylethyl)-cyclohexanol acetate, orange terpenes and eugenol. Of course, lower boiling materials can be included, with the understanding that some loss will occur due to venting.

PROCESS COMPONENTS

The use of the device, the compositions and the processes of this invention are described in more detail hereinafter. Such disclosure is by way of illustration and not limitation of the invention herein. The definitional terms used herein have the following meanings.

By "phase-stable" herein is meant liquid compositions which are homogeneous over their intended usage range (ca. 50° F.–95° F.; 10° C.–35° C.), or which, if stored at temperatures which cause phase separation (~40° F.–110° F.; 4.4° C.–43.3° C.), will revert to their homogeneous state when brought back to temperatures in the intended usage range.

By an "effective amount" herein is meant an amount of the alkyl sulfate and/or alkyl ethoxy sulfate or other surfactant sufficient to provide a phase-stable liquid composition, as defined hereinabove.

By "aqueous" compositions herein is meant compositions which comprise a major portion of water, and optionally the butoxy propoxy propanol (BPP) or other cleaning solvents, the aforesaid surfactants or surfactant mixtures, hydrotropes, perfumes, and the like, especially those disclosed hereinafter.

By "cleaning" herein is meant the removal of soils and stains from fabrics. ("Spot cleaning" is the localized cleaning afforded by the device herein used in a peroxide-containing, preferably non-residue composition.) By "refreshment" herein is meant the removal of malodors and/or wrinkles from the overall fabrics, or the improvement of their overall appearance, other than primarily removing soils and stains, although some soil and stain removal can occur concurrently with refreshment. Typical fabric cleaning refreshment/compositions herein can comprise more water (95–99.9%, preferably greater than 95% up to about 99%) and fewer cleaning ingredients than conventional cleaning or pre-spotting compositions.

By "protuberances" herein is meant knobs, fibers, bristles or like structures which extend outwardly from the surface of the treatment device. Such elements of the device come into contact with the fabric being spot-cleaned ("pre-spotted") to provide mechanical cleaning action.

By "contact with stained areas" with respect to the cleaning device is meant contact which is afforded by impingement of the protuberances, pads, sponges, etc., which comprise the treatment means of the device with the one side of the stained area. As noted above, it is highly desirable that this contact result in a force which is directed substantially downward, i.e., in the Z-direction substantially perpendicular to the surface of the stain, rather than a side-to-side scrubbing motion in the X- and Y-directions, to minimize fabric damage or "wear". Preferably, the contact is associated with a rocking motion by the convex device herein, whereby the curved surface of the device imparts the force in the Z-direction. By "contact with the stained areas" with respect to the stain receiver is meant that the side of the stained area of the fabric opposite the cleaning device directly impinges on the receiver and is in close communication therewith.

As illustrated in the drawings, FIG. 5 shows an integral carrier substrate (1) which is releasably impregnated with the cleaning/refreshment composition. FIG. 6 illustrates one form of a pre-formed, notched containment bag in an open configuration with the loose carrier substrate (1), first side wall **(2*a*), second side wall (2*b*), first fastening device (3), side seal (4) and flexible flap (5). In use, flexible flap (5) is folded along fold line (11)** to provide the vapor-venting closure for the bag.

FIG. 7 shows the "envelope-style" notched bag in a finished configuration and containing the loose carrier substrate sheet (1). In-use, the fabrics to be cleaned/refreshed are placed in the bag with the substrate sheet (1) and flap (5) is folded along fold line (11) to engage first fastening device (3) with the opposing second fastening device (6) to fasten the flap, thereby providing a vapor-venting closure which is sufficiently stable to withstand tumbling in a hot air clothes dryer or similar device.

FIG. 8 shows a cut-away view of the corner of the notched containment bag illustrating the interior of the first side wall **(2*a*) and second side wall (2*b*), first fastening device (3), second fastening device (6), flap (5), and fold line (11). The distance between the edge of the bag (9) and the depth of the notch (11) in second side wall (2*b*)** are dimensions which are set forth hereinabove.

FIG. 9 depicts the un-notched venting bag with the carrier sheet loosely therein.

The dimensions given hereinabove are for containment bags which are designed to tumble freely within the drum of a conventional, U. S.-style in-home hot air clothes dryer having a drum volume of about 170–210 liters (home size).

The bag of the stated dimensions is designed to treat up to about 5 kg fabric load in a single use. The dimensions can be adjusted proportionately for larger or smaller bags to achieve the desired VVE and to ensure effective use in dryers with larger or smaller drums. For example, the total volume of a containment bag constructed for use in an average European home clothes dryer (or U.S. "apartment" size; ca. 90 liter drum volume) would be about 60% of the volume for an average U.S. dryer.

The vapor-venting bags herein can be used with any desired fabric treatment composition which contains water, especially the phase-stable and/or "true solution" liquid fabric cleaning/refreshment compositions, as described more fully hereinafter. The overall process herein provides a method for removing both localized and overall stains, soils and malodors from fabrics and otherwise refreshing fabrics by contacting said fabrics with such compositions.

Carrier—When used in the in-dryer step of the present process, the cleaning and/or refreshment compositions are conveniently used in combination with a carrier substrate, such that the compositions perform their function as the surfaces of the fabrics come in contact with the surface of the carrier. The carrier releasably contains the compositions. By "releasably contains" means that the compositions are effectively released from the carrier onto the soiled fabrics as part of the non-immersion cleaning and/or fabric refreshment processes herein. This release can occur by direct contact between the fabrics and the carrier, by volatilization of the composition from the carrier substrate, or by a combination thereof.

The carrier can be in any desired form, such as powders, flakes, shreds, and the like. However, it will be appreciated that such comminuted carriers would have to be separated from the fabrics at the end of the process. Accordingly, it is highly preferred that the carrier be in the form of an integral pad or sheet which substantially maintains its structural integrity throughout the process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present process. The carriers must not be flammable during the process, nor should they deleteriously interact with the cleaning or refreshment composition or with the fabrics being cleaned. In general, non-woven polyester-based pads or sheets are quite suitable for use as the carrier herein.

The carrier used herein is most preferably non-linting. By "non-linting" herein is meant a carrier which resists the shedding of visible fibers or microfibers onto the fabrics being cleaned, i.e., the deposition of what is known in common parlance as "lint". A carrier can easily and adequately be judged for its acceptability with respect to its non-linting qualities by rubbing it on a piece of dark blue woolen cloth and visually inspecting the cloth for lint residues.

The non-linting qualities of sheet or pad carriers used herein can be achieved by several means, including but not limited to: preparing the carrier from a single strand of fiber; employing known bonding techniques commonly used with nonwoven materials, e.g., point bonding, print bonding, adhesive/resin saturation bonding, adhesive/resin spray bonding, stitch bonding and bonding with binder fibers. In an alternate mode, a carrier can be prepared using an absorbent core, said core being made from a material which, itself, sheds lint. The core is then enveloped within a sheet of porous, non-linting material having a pore size which allows passage of the cleaning or refreshment compositions, but through which lint from the core cannot pass. An example of such a carrier comprises a cellulose or polyester fiber core enveloped in a non-woven polyester scrim.

The carrier should be of a size which provides sufficient surface area that effective contact between the surface of the carrier and the surface of the fabrics being treated is achieved. Of course, the size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a generally rectangular carrier may have the dimensions (X-direction) of from about 20 cm to about 35 cm, and (Y-direction) of from about 18 cm to about 45 cm. Two or more smaller carrier units can be used when a larger surface area is desired (or needed).

The carrier is intended to contain a sufficient amount of the cleaning/refreshment compositions to be effective for their intended purpose. The capacity of the carrier for such compositions will vary according to the intended usage. For example, pads or sheets which are intended for a single use will require less capacity than such pads or sheets which are intended for multiple uses. For a given type of carrier the capacity for the cleaning or refreshment composition will vary mainly with the thickness or "caliper" (Z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 mm. Of course, the foregoing dimensions may vary, as long as the desired quantity of the cleaning or refreshment composition is effectively provided by means of the carrier.

A preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244 and 10444. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference. Preferred materials for use herein have the following physical properties.

| | Grade 10244 | Targets | Optional Range |
|---|---|---|---|
| Basis Weight | $gm/m^2$ | 55 | 35–75 |
| Thickness | microns | 355 | 100–1500 |
| Density | gm/cc | 0.155 | 0.1–0.25 |

-continued

| | Grade 10244 | Targets | Optional Range |
|---|---|---|---|
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 ($H_2O$) |
| Dry Mullen | gm/cm$^2$ | 1050 | 700–1200 |

*MD-machine direction; CD-cross direction

As disclosed in U.S. Pat. Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning/refreshment compositions herein, but actually optimizes cleaning performance. While not intending to be limited by theory, it may be speculated that this carrier is more effective in delivering the compositions to soiled fabrics. Or, this particular carrier might be better for removing soils by contact with the soiled fabrics, due to its mixture of fibers. Whatever the reason, improved cleaning performance is secured.

In addition to the improved performance, it has now been discovered that this hydroentangled carrier material provides an additional, unexpected benefit due to its resiliency. In-use, the sheets herein are designed to function in a substantially open configuration. However, the sheets may be packaged and sold to the consumer in a folded configuration. It has been discovered that carrier sheets made from conventional materials tend to undesirably revert to their folded configuration in-use. This undesirable attribute can be overcome by perforating such sheet, but this requires an additional processing step. It has now been discovered that the hydroentangled materials used to form the carrier sheet herein do not tend to re-fold during use, and thus do not require such perforations (although, of course, perforations may be used, if desired). Accordingly, this attribute of the hydroentangled carrier materials herein makes them optimal for use in the manner of the present invention.

Controlled Release Carriers—Other carriers which can be used in the present invention are characterized by their ability to absorb the liquid compositions, and to release them in a controlled manner. Such carriers can be single-layered or multi-layer laminates. In one embodiment, such controlled-release carriers can comprise the absorbent core materials disclosed in U.S. Pat. No. 5,009,653, issued Apr. 23, 1991, to T. W. Osborn III, entitled "Thin, Flexible Sanitary Napkin", assigned to The Procter & Gamble Company, incorporated herein by reference. Another specific example of a controlled-release carrier herein comprises a hydroentangled web of fibers (as disclosed above) having particles of polymeric gelling materials dispersed, either uniformly or non-uniformly, in the web. Suitable gelling materials include those disclosed in detail at columns 5 and 6 of Osborn, as well as those disclosed in U.S. Pat. No. 4,654,039, issued Mar. 31, 1987, to Brandt, Goldman and Inglin. Other carriers useful herein include WATER-LOCK® L-535, available from the Grain Processing Corporation of Muscatin, Iowa. Non-particulate superabsorbents such as the acrylate fibrous material available under the tradename LANSEAL F from the Choli Company of Higashi, Osaka Japan and the carboxymethylcellulose fibrous material available under the tradename AQUALON C from Hercules, Inc., of Wilmington, Del. can also be used herein. These fibrous superabsorbents are also convenient for use in a hydro-entangled-type web.

In another embodiment the controlled release carrier can comprise absorbent batts of cellulosic fibers or multiple layers of hydroentangled fibers, such as the HYDRASPUN sheets noted above. In this embodiment, usually 2 to about 5 sheets of HYDRASPUN, which can optionally be spot-bonded or spot-glued to provide a coherent multi-layered structure, provides an absorbent carrier for use herein without the need for absorbent gelling materials, although such gelling materials can be used, if desired. Other useful controlled release carriers include natural or synthetic sponges, especially open-cell polyurethane sponges and/or foams. Whatever controlled release carrier is selected, it should be one which imbibes the liquid compositions herein thoroughly, yet releases them with the application of pressure or heat. Typically, the controlled release carriers herein will feel wet or, preferably, somewhat damp-to-nearly dry to the touch, and will not be dripping wet when carrying 10–30 g. of the cleaning composition.

Coversheet—In an optional embodiment, a liquid permeable coversheet is superimposed over the carrier. In one embodiment, the coversheet is associated with the carrier by spray-gluing the coversheet to the surface of the carrier. The coversheet is preferably a material which is compliant and soft feeling. Further, the coversheet is liquid and/or vapor pervious, permitting the aqueous cleaning/refreshment composition to transfer through its thickness. A suitable coversheet may be manufactured from a wide range of materials such as polymeric materials, formed thermoplastic films, apertured plastic films, porous films, reticulated foams, natural fibers (e.g., wood or cotton fibers), woven and non-woven synthetic fibers (e.g., polyester or polypropylene fibers) or from a combination of natural and synthetic fibers, with apertured formed films being preferred. Apertured formed films are preferred for the coversheet because they are pervious to the liquid cleaning and/or refreshment compositions (or vapors) and yet non-absorbent. Thus, the surface of the formed film which is in contact with the fabrics remains relatively dry, thereby further reducing water spotting and dye transfer. Moreover, the apertured formed films have now been found to capture and retain lint, fibrous matter such as pet hair, and the like, from the fabric being treated, thereby further enhancing the cleaning/refreshment benefits afforded by the present process. Suitable formed films are described in U.S. Pat. No. 3,929,135, entitled "Absorptive Structure Having Tapered Capillaries", issued to Thompson on Dec. 30, 1975; U.S. Pat. No. 4,324,246, entitled "Disposable Absorbent Article Having A Stain Resistant Coversheet", issued to Mullane and Smith on Apr. 13, 1982; U.S. Pat. No. 4,342,314, entitled "Resilient Plastic Web Exhibiting Fiber-Like Properties", issued to Radel and Thompson on Aug. 3, 1982; and U.S. Pat. No. 4,463,045, entitled "Macroscopically Expanded Three-Dimensional Plastic Web Exhibiting Non-Glossy Visible Surface and Cloth-Like Tactile Impression"; issued to Ahr, Louis, Mullane and Ouellete on Jul. 31, 1984, all of which are incorporated herein by reference. If used, such formed-film cover-sheets with their tapered capillary apertures preferably are situated over the carrier sheet such that the smaller end of the capillary faces the carrier sheet and the larger end of the capillary faces outward.

In further regard to the coversheet herein, it is also possible to employ permeable nonwoven or woven fabrics to cover the carrier-plus-cleaning/refreshment composition. Under certain circumstances, such nonwoven or woven fibrous coversheets can offer some advantages over the formed-film coversheets. For example, formed-film coversheets are often manufactured by hydroforming processes which are particularly suitable with polymer films such as polyethylene. While polyethylene can be used herein, there is some prospect that, due to its lower melting point, high dryer temperatures can cause its softening and/or melting in-use. This is particularly true if the article herein were to be released from the containment bag and fall into the hot dryer drum. While it is possible to prepare formed-film topsheets using nylon, polyester or other heat resistant polymeric sheets, such manufacture becomes somewhat more difficult and, hence, more expensive.

Fibrous coversheets can also be made from non-heat resistant fibers such as polyethylene. However, it has now been determined that preferred fibrous coversheets can be prepared using nylon (especially nylon-6), polyester, and the like, heat-resistant fibers which can withstand even inadvertent misuse in the present process. The flexible, cloth-like, permeable topsheets made therefrom are known materials in the art of nonwoven and woven fabric making, and their manufacture forms no part of the instant invention. Such nonwovens are available commercially from companies such as Dexter Corporation. The hydrophobic character of the fibers used to manufacture such nonwoven or woven fibrous coversheets helps reduce the chances of water spotting during the process herein. Such coversheets also pick up vagrant lint and other fibers from the fabrics being treated in the present process, thereby enhancing their overall clean/refreshed appearance.

Such nonwoven or woven fibrous sheet materials can be used in a single layer or as multiple layers as the coversheet herein. In one embodiment, an absorbent core comprising the cleaning/refreshment composition is enrobed in a polyester or polyamide fibrous coversheet which has been ring rolled or otherwise crimped to provide three dimensional bulk. Optionally, this coversheet may be further covered by a second coversheet in an uncrimped configuration. Or, the core can be enrobed in one or more layers of uncrimped fibrous coversheeting. Alternatively, a formed-film coversheet with tapered capillaries and made from a non-heat resistant material can be covered with a protective scrim of a woven or nonwoven fibrous coversheet comprising heat resistant fibers.

Such fibrous, preferably heat resistant and, most preferably, hydrophobic, coversheets thus provide alternative embodiments of the article herein. Various combinations can be employed, according to the desires of the manufacturer, without departing from the spirit and scope of the invention. The objective in each instance is to prevent the wet carrier core of the article from coming into prolonged, direct contact with the fabric being treated so as to avoid water spotting. If desired, the coversheet can be provided with macroscopic fenestrations through which lint, fibers or particulate soils can pass, thereby helping to entrap such foreign matter inside the article, itself.

In a preferred embodiment of the present invention, the outer surface coversheet is preferably hydrophobic. However, if desired the inner and outer surfaces of the coversheet can be made hydrophilic by treatment with a surfactant which is substantially evenly and completely distributed throughout the surface of the coversheet. This can be accomplished by any of the common techniques well known to those skilled in the art. For example, the surfactant can be applied to the coversheet by spraying, by padding, or by the use of transfer rolls. Further, the surfactant can be incorporated into the polymeric materials of a formed film coversheet. Such methods are disclosed in U.S. Pat. No. 5,009,653, cited above.

OVERALL PROCESS

The preferred pre-spotting procedure for removing stains from a stained area of fabrics, comprises applying a spot cleaning composition (preferably, substantially free of visible residues as described herein) to said stained areas, and rocking the arcuate device herein on the stain using hand pressure to remove it. In a preferred mode, in the pre-spotting step of the process herein the spot cleaning composition is applied to the fabric by any convenient means, e.g., by spraying, daubing, pouring, and the like. In an alternate mode, the pre-spotting process can be conducted by contacting the stained area during the rocking step with the carrier sheet which is saturated with the spot cleaning composition. Conveniently, the fabric and carrier sheet can be positioned in a holding tray or other suitable receptacle as a containment system for the cleaning composition.

In more detail, the overall process herein can be conducted in the following manner. Modifications of the process can be practiced without departing from the spirit and scope of the present invention.

1. Place the stained area of the fabric over and in contact with the stain receiver described herein or, less preferably, an ordinary folded paper towel (e.g., preferably white or non-printed—to avoid dye transfer from the towel—BOUNTY®brand) on any suitable surface such as a table top, in a tray, etc.
2. Apply enough peroxide-containing spot cleaning composition from a bottle with a narrow spout which directs the composition onto the stain (without unnecessarily saturating the surrounding area of the fabric) to saturate the localized stained area—about 10 drops; more may be used for a larger stain.
3. Optionally, let the composition penetrate the stain for 3–5 minutes. (This is a pre-treat or pre-hydration step for better cleaning results.)
4. Optionally, apply additional composition—about 10 drops; more may be used for larger stains.
5. Use the spot removal device to work stain completely out. Rock the device (Z-direction force) firmly against the stain typically for 20–120 seconds, longer for tougher stains. Do not rub (X–Y direction force) the stain with the device since this can harm the fabric.
6. Optionally, blot the fabric, e.g., between paper towels, to remove excess composition. Or, the treated area can be blotted with a dampened sponge or other absorbent medium to flush the fibers and remove excess composition.
7. Conduct the in-dryer cleaning/refreshment process disclosed herein on the entire fabric using the vapor-venting bag.
8. Following Step 7, it is preferred to promptly hang the slightly moist fabrics to avoid re-wrinkling and to complete the drying. Alternatively, the fabrics can be ironed.

An overall process for treating an entire area of fabric surface, which comprises a prespotting operation according to this invention, thus comprises the overall steps of:

(i) conducting a stain removal process according to the above disclosure on localized stained areas of fabric;

(ii) placing the entire fabric from step (i) together with a carrier releasably containing the aqueous fabric cleaning/refreshment composition in the vapor-venting containment bag;

(iii) placing the bag in a device to provide agitation, e.g., such as in a hot air clothes dryer and operating the dryer with heat and tumbling to moisten the fabric and provide vapor venting; and (iv) removing the fabric from the bag.

Again, the fabrics are promptly hung to complete drying and/or to prevent re-wrinkling.

In a convenient mode, a portion of the liquid composition is directed onto the stained area of the fabric from a bottle. As shown in FIG. 4, the protuberances on the cleaning device are brought into close contact with the stain, e.g., by rocking the arcuate device on the stain, typically using hand pressure. Side-to-side rubbing with the device is preferably avoided to minimize potential fiber damage. Contact can be maintained for a period of 1–60 seconds for lighter stains and 1–5 minutes, or longer, for heavier or more persistent stains.

The second step of the overall process is conveniently conducted in a tumbling apparatus, preferably in the presence of heat. The nylon or other heat-resistant vapor-venting bag with the carrier plus aqueous cleaning/refreshment composition and containing the pre-spotted fabric being cleaned and refreshed is closed and placed in the drum of an automatic hot air clothes dryer at temperatures of 40° C.–150° C. The drum is allowed to revolve, which imparts a tumbling action to the bag and agitation of its contents concurrently with the tumbling. By virtue of this agitation, the fabrics come in contact with the carrier containing the composition. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user. During the step, greater than about 40% of the moisture is vented from the bag.

With respect to the wrinkle-removing function of the process and compositions herein, it will be appreciated that wrinkling can be affected by the type of fabric, the fabric weave, fabric finishes, and the like. For fabrics which tend to wrinkle, it is preferred not to overload the containment bag used herein. Thus, for a bag with, for example, an operational capacity of up to about 5 kg of fabrics, it may be best to process up to only about 60% of capacity, (i.e., up to about 3 kg) of fabrics to further minimize wrinkling.

The following examples illustrate the present invention in more detail, but are not intended to be limiting thereof.

EXAMPLE I

Examples of preferred, high water content, low residue compositions for use in the pre-spotting step herein are as follows. The compositions are listed as "nonionic" or "anionic", depending on the type of surfactant used therein. These compositions are used in the manner disclosed in the Examples hereinafter.

| INGREDIENT | Nonionic Composition (%) | Anionic Composition (%) |
|---|---|---|
| Hydrogen peroxide | 1.000 | 1.000 |
| Amino tris(methylene phosphonic acid)* | 0.040 | 0.0400 |
| Butoxypropoxypropanol (BPP) | 2.000 | 2.000 |
| NEODOL 23 6.5 | 0.250 | — |
| $NH_4$ Coconut $E_1S$ | — | 0.285 |
| Dodecyldimethylamine oxide | — | 0.031 |
| Magnesium chloride | — | 0.018 |
| Magnesium sulfate | — | 0.019 |
| Hydrotrope, perfume, other minors, | — | 0.101 |
| Kathon preservative | 0.0003 | 0.0003 |
| Water (deionized or distilled) | 96.710 | 96.507 |
| Target pH | 6.0 | 6.0 |

*Stabilizer for hydrogen peroxide

Preferably, to minimize the potential for damage as disclosed hereinabove, such compositions comprise the anionic or nonionic surfactant in an amount (by weight of composition) which is less than the amount of $H_2O_2$. Preferably, the weight ratio of surfactant:$H_2O_2$ is in the range of about 1:10 to about 1:1.5, most preferably about 1:4 to about 1:3.

EXAMPLE II

A low residue liquid fabric cleaning/refreshment product for use in a vented dryer bag is prepared, as follows.

| Ingredient | % (wt.) |
|---|---|
| Water | 99.3 |
| Emulsifier (TWEEN 20)* | 0.3 |
| Perfume | 0.4 |

*Polyoxyethylene (20) sorbitan monolaurate available from ICI Surfactants.

23 Grams of the product are applied to a 11 in.×15 in. (28 cm×38 cm) carrier sheet of non-woven fabric, preferably HYDRASPUN®. In simple, yet effective, mode, the carrier sheet is placed in a pouch and saturated with the product. The capillary action of the substrate and, optionally, manipulation and/or laying the pouch on its side, causes the product to wick throughout the sheet. Preferably, the sheet is of a type, size and absorbency that is not "dripping" wet from the liquid. The pouch is sealed so that the liquid composition is stable to storage until use.

Step 1. A fabric to be cleaned and refreshed is selected. Localized stained areas of the fabric are situated over an absorbent stain receiver and are treated by directly applying about 0.5–5 mls (depending on the size of the stain) of the liquid product of Example I, which is gently worked into the fabric using the device herein. The treated stains are padded with dry paper toweling. In an alternate mode, the product is releasably absorbed on a carrier sheet and applied to the stains, which are then treated with the device herein, using a rocking motion, with hand pressure.

Step 2. Following the pre-spotting step, the fabric is placed into a vapor-venting nylon bag (as disclosed above) together with the sheet (which is removed from its storage pouch and unfolded) releasably containing the cleaning/refreshment product of Example II. The mouth of the bag is closed to provide vapor-venting, and the bag and its contents are placed in the drum of a conventional hot air clothes dryer. The dryer is operated in standard fashion for 20–60 minutes at a high heat setting (an air temperature range of about 140°–170° F.; 60°–70° C.). After the tumbling action of the dryer ceases, the cleaned and refreshed fabric is removed from the bag. The used sheet is discarded.

EXAMPLE III

High water content ("Sweet Water"), low residue cleaning/refreshment compositions for use in the dryer in the processes herein are as follows. The compositions are used in the manner disclosed hereinabove to clean and refresh fabrics.

| Components | Percent | Range (%) | Function |
|---|---|---|---|
| Water De-ionized | 98.8997 | 97–99.9 | Vapor Phase Cleaning |
| TWEEN 20 | 0.50 | 0.5–1.0 | Wetting agent |
| Perfume | 0.50 | 0.1–1.50 | Scent, Aesthetics |
| KATHON CG* | 0.0003 | 0.0001–0.0030 | Anti-bacterial |
| Sodium Benzoate* | 0.10 | 0.05–1.0 | Anti-fungal |

*Optional preservative ingredients.

20–30 Grams, preferably about 23 grams, of the Sweet Water composition is absorbed into a 28 cm×38 cm HYDRASPUN® carrier sheet (the sheet is preferably not "dripping" wet) which is of a size which provides sufficient surface area that effective contact between the surface of the carrier sheet and the surface of the fabrics being cleaned and refreshed is achieved. The sheet is used in the foregoing manner to clean and refresh fabrics in a hot air clothes dryer.

EXAMPLE IV

A liquid pre-spotting composition is formulated by admixing the following ingredients.

| Ingredient | % (wt.) |
|---|---|
| BPP | 4.0 |
| $C_{12}$–$C_{14}$ AS, Na salt | 0.25 |
| $H_2O_2$ | 1.0 |
| Water and minors* | Balance |

*Includes preservatives such as KATHON ® at levels of 0.00001%–1%, by weight.

The fabric to be treated is laid flat on an absorbent stain receiver and 0.5 ml–4 ml of the composition is applied directly to the stain and worked in by means of the arcuate cleaning device, using a rocking motion.

Other useful compositions which can be used in this step are as follows:

| Ingredient | Percent (wt.) | (Range; wt.) |
|---|---|---|
| BPP | 4.0 | 0.1–4.0% |
| $C_{12}$–$C_{14}$ AS | 0.4 | 0.1–0.5% |
| Nonionic Surfactant (optional)* | 0.1 | 0–0.5% |
| $H_2O_2$ | 0.25 | 0.25–7.0 |
| Water (distilled or deionized) | Balance | 95–99.8% |
| Target pH = 5.0–7.0, preferably 6.0. | | |

*The optional nonionic surfactants in the compositions herein are preferably $C_{12}$–$C_{14}$ N-methyl glucamides or ethoxylated $C_{12}$–$C_{16}$ alcohols (EO 1–10).

The foregoing illustrates pre-spotting compositions using the AS surfactant. Improved cleaning performance can be achieved using MgAES and amine oxide surfactants, although possibly with some reduction in phase stability. Thus, aqueous compositions with ca. 2–3% BPP can be stabilized using MgAES surfactants. However, for compositions containing 4%, and higher, BPP, the formulator may wish to include AS surfactant. The amount and blend of surfactants will depend on the degree of temperature-dependent phase stability desired by the formulator. Amine oxide surfactants such as dimethyl dodecyl amine oxide can also be used in the compositions.

The pre-spotted fabric is then placed in a flexible venting "Envelope"-style bag as shown in the Figures together with a sheet releasably containing about 20–30 grams of a high water cleaning/refreshment composition according to any of the foregoing disclosures, and optionally containing BPP on other cleaning solvents herein at levels from 0.5%–6%. The bag is closed using a VELCRO®-type fastener. The closure provides a vapor-venting gap along the mouth of the bag, but is sufficiently robust to retain the fabric in the bag during the treatment. In a typical mode, the bag will have a volume of about 25,000 $cm^3$, which will accommodate up to about 2 kg of dry fabrics. When the fabrics and the sheet are placed in the bag, the air is preferably not squeezed out of the bag before closing. The closed bag is placed in a conventional hot-air clothes dryer. The dryer is started and the bag is tumbled for a period of 20–30 minutes at a dryer air temperature in the range from about 40° C. to about 150° C. During this time, the sheet comes into close contact with the fabrics. The water vapors and malodorous, volatile materials are released from the bag through the vent at the mouth of the bag and thence out of the dryer. After the machine cycle is complete, the fabrics are removed from the bag and hung to complete the drying and to avoid wrinkles, and the spent sheet is discarded. The bag is retained for re-use. The fabrics are cleaned, refreshed and essentially wrinkle-free. Excellent overall cleaning, refreshment and de-wrinkling are secured when from about 8 g to about 200 g of the preferred compositions herein are used per kilogram of fabric being treated.

As can be seen from the disclosure herein, the present invention thus provides: in a process for cleaning/refreshing fabrics, preferably in a hot air apparatus such as a conventional clothes dryer, the improvement which comprises, in a spot removal step for cleaning localized soiled areas of the fabrics, applying a peroxide-containing spot cleaning composition to said areas and contacting said areas with the convex device herein, preferably using hand pressure with a rocking motion, whereby soils are removed from the fabrics without frictional damage to said fabrics. In a further improvement, the spot cleaning composition comprises above about 90%, preferably above about 95%, by weight of water. In still a further improvement, the aforesaid aqueous composition is prepared from ingredients such as those described herein which do not leave unacceptable amounts of (or any) visible residues on the fabric. In still a further improvement, the usage of detersive surfactants in the compositions is within the recited parameters herein.

EXAMPLE V

A fabric to be cleaned is visually inspected for areas with high stain levels. Such areas are moistened with the peroxide composition herein by gently dabbing them with a sheet article of the foregoing type. As shown in FIG. 4, the device is used to loosen the stain without damaging the fabric surface. As also shown in FIG. 4, an absorbent stain receiver in the form of a pad (501) of FAM foam or the TBAL structure described above underlies the stained (207) area of the fabric during the pre-spotting process. Once the stain is loosened, the area of the fabric can optionally then again be patted with the sheet article.

The pre-spotted fabric and sheet article are then placed in a flexible bag (preferably, heat and vapor resistant, most preferably prepared from 1–3 mil nylon film). The bag is closed using a VELCRO®-type fastener. Other fasteners such as nylon zipper and ZIP-LOK®-type fasteners may also be used. In a typical mode, the bag will have a volume of about 25,000 $cm^3$, which will accommodate up to about 2 kg of dry fabrics. When the fabrics and the dry cleaning sheet are placed in the bag, the air is preferably not squeezed out of the bag before closing and sealing. This allows the bag to billow, thereby providing sufficient space for the fabrics and cleaning sheet to tumble freely together. The bag is placed in a conventional hot-air clothes dryer. The dryer is started and the bag is tumbled for a period of 20–30 minutes at a dryer air temperature in the range from about 40° C. to about 150° C. During this time, the sheet comes into close contact with the fabrics. After the machine cycle is complete, the bag and its contents are removed from the dryer, and the spent dry cleaning sheet is discarded. The nylon bag is retained for re-use. The fabrics are cleaned and refreshed. The water present in the cleaning composition serves to minimize wrinkles in the fabrics. Excellent overall cleaning is secured when from about 3 g to about 50 g of the "Sweet Water" compositions herein are used per kilogram of fabric being cleaned.

Besides the optional nonionic surfactants in the cleaning compositions herein, which are preferably $C_8$–$C_{18}$ ethoxylated (E01-15) alcohols or the corresponding ethoxylated alkyl phenols, the compositions can contain enzymes to further enhance cleaning performance. Lipases, amylases and protease enzymes, or mixtures thereof, can be used. If used, such enzymes will typically comprise from about 0.001% to about 5%, preferably from about 0.01% to about 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

If an antistatic benefit is desired, the compositions used herein can contain an anti-static agent. If used, such anti-static agents will typically comprise at least about 0.5%, typically from about 2% to about 8%, by weight, of the compositions. Preferred anti-stats include the series of sulfonated polymers available as VERSAFLEX 157, 207, 1001, 2004 and 7000, from National Starch and Chemical Company.

The compositions herein can optionally be stabilized for storage using conventional preservatives such as KATHON® at a level of 0.0001%–1%, by weight.

EXAMPLE VI

In an alternate mode, the pre-spotting operation herein for removing stain from a localized area on a fabric can be conducted by:

(a) underlying the area containing said stain with an absorbent stain receiver;

(b) applying a fluid cleaner (pre-spotter) composition to said stain from a container having a dispenser spout; and (c) rubbing or pressing said cleaning composition into said stain using the distal tip of said spout, whereby said stain is transferred into the stain receiver.

In this mode, the face of the distal tip of said spout can be concave, convex, flat, or the like. The combination of container plus spot is referred to herein conjointly as the "dispenser".

In more detail, the dispenser used herein comprises a container for the fluid pre-spotting composition, said container having a dispensing means which comprises a spout, preferably in the form of a hollow tube, which is connected to said container and is in communication with the interior of the container. In-use, a portion of the liquid composition within the interior of said container flows out of the container through said spout, out the distal tip of said spout, and onto the stain which is being treated. The user then manipulates the composition by daubing, smearing, pressing, or the like, using the distal tip to work the composition into the stain. A circular, rubbing motion is typical. By this means, the composition can be focused on the stained area. As the stain is loosened by the combined use of the aforesaid mechanical manipulation and the pre-spotting composition, the stain residues and the pre-spotting composition are transferred away from the fabric and into the underlying stain receiver. The fabric is then preferably re-positioned so that a fresh area of stain receiver underlays other stained areas, and the process is repeated until the pre-spotting operation is completed. The fabrics can then be used, as desired, or otherwise laundered or dry-cleaned.

A typical dispenser herein has the following dimensions, which are not to be considered limiting thereof. The volume of the container bottle used on the dispenser is typically 2 oz.–4 oz. (fluid ounces; 59 mls to 118 mls). The container larger size bottle can be high density polyethylene. Low density polyethylene is preferably used for the smaller bottle since it is easier to squeeze. The overall length of the spout is about 0.747 inches (1.89 cm). The spout is of a generally conical shape, with a diameter at its proximal base (where it joins with the container bottle) of about 0.596 inches (1.51 cm) and at its distal of 0.182 inches (4.6 mm). The channel within the spout through which the pre-spotting fluid flows is approximately 0.062 inches (1.57 mm). In this embodiment, the channel runs from the container bottle for a distance of about 0.474 inches (1.2 cm) and then expands slightly as it communicates with the concavity at the distal end of the spout.

A pre-spotting formula for use herein with the cleaning device and which can also be used with the dispenser is as follows.

| INGREDIENT | % (Wt.) (Nonionic) |
|---|---|
| Hydrogen peroxide | 1.000 |
| Amino tris(methylene phosphonic acid)* | 0.040 |
| Butoxypropoxypropanol (BPP) | 2.000 |
| NEODOL 23 6.5 | 0.250 |
| Kathon preservative | 0.0003 |
| Water | 96.710 |
| pH target = 7; range = 6–8 | |

*Stabilizer for hydrogen peroxide

The following example illustrates a FAM-foam type of stain receiver for use in the pre-spotting process herein. The acquisition and absorbency of the FAM with respect to the liquid pre-spotting compositions herein is superior to most other types of absorbent materials. For example, the FAM has a capacity of about 6 g ($H_2O$) per gram of foam at a suction pressure of 100 cm of water. By contrast, cellulose wood fiber structures have substantially no capacity above about 80 cm of water. Since, in the present process the volume of liquid pre-spotter used is relatively low (a few milliliters is typical) the amount of FAM used can be small. This means that the pad of FAM which underlays the stained area of fabric can be quite thin and still be effective. However, if too thin, the pad may tend to crumble, in-use. (As noted above, a backing sheet can be applied to the FAM to help maintain its integrity.)

Stain receiver pads made of FAM foam can be used in either of two ways. In one mode, the uncompressed foam is used. Uncompressed FAM pads having a thickness in the range of about 0.3 mm to about 15 mm are useful. In another mode, the FAM foam can be used in a compressed state which swells as liquid pre-spotter with its load of stain material is imbibed. Compressed FAM foams having thicknesses in the range of about 0.02 inches (0.5 mm) to about 0.135 inches (3.4 mm) are suitable herein.

The preparation of FAM foam (also sometimes referred to in the literature as "HIPE", i.e., high internal phase emulsion) is described in the patents cited hereinabove. The following Example illustrates the preparation of a compressed foam for use herein having a thickness of about 0.025 inches (0.063 cm). Such compressed foams in the 0.025 in.–0.027 in. (0.063 cm–0.068 cm) range are especially useful as the stain receiver herein.

EXAMPLE VII

Preparation of Emulsion and FAM Foams Therefrom

A) Emulsion Preparation

Anhydrous calcium chloride (36.32 kg) and potassium persulfate (189 g) are dissolved in 378 liters of water. This provides the water phase stream to be used in a continuous process for forming the emulsion.

To a monomer combination comprising distilled divinylbenzene (42.4% divinylbenzene and 57.6% ethyl styrene) (1980 g), 2-ethylhexyl acrylate (3300 g), and hexanedioldiacrylate (720 g) is added a diglycerol monooleate emulsifier (360 g), ditallow dimethyl ammonium methyl sulfate (60 g), and Tinuvin 765 (15 g). The diglycerol monooleate emulsifier (Grindsted Products; Brabrand, Denmark) comprises approximately 81% diglycerol monooleate, 1% other diglycerol monoesters, 3% polyols, and 15% other polyglycerol esters, imparts a minimum oil/water interfacial tension value of approximately 2.7 dyne/cm and has an oil/water critical aggregation concentration of approximately 2.8 wt. %. After mixing, this combination of materials is allowed to settle overnight. No visible residue is formed and all of the mixture is withdrawn and used as the oil phase in a continuous process for forming the emulsion.

Separate streams of the oil phase (25° C.) and water phase (53°–55° C.) are fed to a dynamic mixing apparatus. Thorough mixing of the combined streams in the dynamic mixing apparatus is achieved by means of a pin impeller. The pin impeller comprises a cylindrical shaft of about 36.8 cm in length with a diameter of about 2.5 cm. The shaft holds 6 rows of pins, 3 rows having 33 pins and 3 rows having 32 pins, each having a diameter of 0.5 cm extending outwardly from the central axis of the shaft to a length of 2.5 cm. The pin impeller is mounted in a cylindrical sleeve which forms the dynamic mixing apparatus, and the pins have a clearance of 1.5 mm from the walls of the cylindrical sleeve.

A minor portion of the effluent exiting the dynamic mixing apparatus is withdrawn and enters a recirculation zone; see PCT U.S. 96/00082 published 18 Jul. 1996 and EPO 96/905110.1 filed 11 Jan. 1996. The Waukesha pump in the recirculation zone returns the minor portion to the entry point of the oil and water phase flow streams to the dynamic mixing zone.

The combined mixing and recirculation apparatus set-up is filled with oil phase and water phase at a ratio of 4 parts water to 1 part oil. The dynamic mixing apparatus is vented to allow air to escape while filling the apparatus completely. The flow rates during filling are 7.6 g/sec oil phase and 30.3 cc/sec water phase.

Once the apparatus set-up is filled the vent is closed. Agitation is then begun in the dynamic mixer, with the impeller turning at 1450 RPM and recirculation is begun at a rate of about 30 cc/sec. The flow rate of the water phase is then steadily increased to a rate of 151 cc/sec over a time period of about 1 min., and the oil phase flow rate is reduced to 3 g/sec over a time period of about 3 min. The recirculation rate is steadily increased to about 150 cc/sec during the latter time period. The back pressure created by the dynamic mixer and static mixing zone (TAH Industries Model Number 101-212) at this point is about 14.7 PSI (101.4 kPa), which represents the total back pressure of the system. The Waukesha pump speed is then steadily decreased to a yield a recirculation rate of about 75 cc/sec. The impeller speed in then steadily increased to 1550 RPM over a period of about 10 seconds. The back pressure increases to about 16.3 PSI (112 kPa).

B) Polymerization of Emulsion

The emulsion flowing from the static mixer is collected in a round polypropylene tub, 17 in. (43 cm) in diameter and 7.5 in (10 cm) high, with a concentric insert made of Celcon plastic. The insert is 5 in (12.7 cm) in diameter at its base and 4.75 in (12 cm) in diameter at its top and is 6.75 in (17.1 cm) high. The emulsion-containing tubs are kept in a room maintained at 65° C. for 18 hours to bring about polymerization and form the foam.

C) Foam Washing and Dewatering

The cured FAM foam is removed from the curing tubs. The foam at this point has residual water phase (containing dissolved emulsifiers, electrolyte, initiator residues, and initiator) about 45–55 times (45–55×) the weight of polymerized monomers. The foam is sliced with a sharp reciprocating saw blade into sheets which are 0.185 inches (0.47 cm) in thickness. These sheets are then subjected to compression in a series of 2 porous nip rolls equipped with vacuum which gradually reduce the residual water phase content of the foam to about 6 times (6×) the weight of the polymerized material. At this point, the sheets are then resaturated with a 1.5% $CaCl_2$ solution at 60° C., are squeezed in a series of 3 porous nip rolls equipped with vacuum to a water phase content of about 4×. The $CaCl_2$ content of the foam is between 8 and 10%.

The foam remains compressed after the final nip at a thickness of about 0.025 in. (0.063 cm). The foam is then dried in air for about 16 hours. Such drying reduces the moisture content to about 9–17% by weight of polymerized material. At this point, the foam sheets are very drapeable. In this collapsed state, the density of the foam is about 0.14 g/cc.

As noted above, for use as a stain receiver in the pre-spotting operation herein, a sheet of the FAM is placed beneath and in close contact with the backside of the stained area of a fabric. A portion of pre-spotting composition is dispensed onto the frontside of the fabric and manipulated into the stain by means of the cleaning device or dispenser tip, as disclosed hereinabove. The excess pre-spotting composition and its load of stain material are thereby transferred into the underlying foam pad.

EXAMPLE VIII

A kit for sale to consumers is assembled and comprises:

(a) a convex cleaning device as shown in the figures;

(b) a portion of the peroxide-containing spot cleaning composition herein;

(c) a re-usable containment bag which can be non-venting or, preferably, venting;

(d) multiple (typically 3–10) single-use cleaning/refreshment sheets;

(e) optionally, a re-usable holding tray; and (f) optionally, one or more stain receivers.

Usage instructions are included with the kit.

What is claimed is:

1. An overall non-immersion cleaning process for treating a stained fabric, which comprises a prespotting operation and comprising the overall steps of:

(a) applying a spot cleaning composition to said stained area wherein the spot cleaning composition comprises:
  (1) at least about 89%, by weight, of water;
  (2) from about 1% to about 10%, by weight, of an organic cleaning solvent;
  (3) from about 0.25% to about 7%, by weight, of hydrogen peroxide;
  (4) from about 0.05% to about 2%, by weight, of a detersive surfactant;
  (5) from about 0.01% to about 1%, by weight, of a peroxide-stabilizing amount of a chelating agent; and
  (6) less than about 0.3%, by weight, of a polyacrylate emulsifier;

(b) concurrently or consecutively with Step (a), contacting the stained area of the fabrics with the treatment members of a convex cleaning device;

(c) applying Z-directional force to said device;

(d) placing the prespotted fabric together with a carrier containing an aqueous cleaning/refreshing composition in a containment bag;

(e) placing the bag in a hot air clothes dryer and operating the dryer with heat and tumbling; and (f) removing the fabric from the bag.

2. A process according to claim 1 wherein vapors are vented from the bag during step (e).

3. An overall laundering process for treating a stained area of fabric, which comprises a prespotting operation, comprising the overall steps of:

(a) applying a spot cleaning composition to said stained area wherein the spot cleaning composition comprises:
  (1) at least about 89%, by weight, of water;
  (2) from about 1% to about 10%, by weight, of an organic cleaning solvent;
  (3) from about 0.25% to about 7%, by weight, of hydrogen peroxide;
  (4) from about 0.05% to about 2%, by weight, of a detersive surfactant;
  (5) from about 0.01% to about 1%, by weight, of a peroxide-stabilizing amount of a chelating agent; and
  (6) less than about 0.3%, by weight, of a polyacrylate emulsifier;

(b) concurrently or consecutively with Step (a), contacting the stained area of the fabrics with the treatment members of a convex cleaning device;

(c) applying Z-directional force to said device; and (d) laundering the fabrics in a conventional aqueous laundering process.

4. A dry cleaning kit, comprising:

(a) a convex cleaning device;

(b) a spot cleaning composition comprising:
  (1) at least about 89%, by weight, of water;
  (2) from about 1% to about 10%, by weight, of an organic cleaning solvent;
  (3) from about 0.25% to about 7%, by weight, of hydrogen peroxide;
  (4) from about 0.05% to about 2%, by weight, of a detersive surfactant;
  (5) from about 0.01% to about 1%, by weight, of a peroxide-stabilizing amount of a chelating agent; and
  (6) less than about 0.3%, by weight, of a polyacrylate emulsifier;

(c) a re-usable containment bag;

(d) multiple, single-use sheets releasably containing an aqueous cleaning/refreshment composition; and (e) optionally, a re-usable holding tray; and (f) optionally, one or more absorbent stain receivers.

5. A kit according to claim 4 which additionally contains usage instructions which promote the use of a downward rocking motion with said device and which discourages the use of a side-to-side scrubbing motion.

6. A kit according to claim 5 wherein said instructions are included on the device, itself.

7. The overall non-immersion cleaning process of claim 1, wherein the organic cleaning solvent is butoxy propoxy propanol.

8. The overall non-immersion cleaning process of claim 1, wherein the hydrogen peroxide is present at a concentration from about 0.5% to about 3%, by weight.

9. The overall non-immersion cleaning process of claim 1, wherein the spot cleaning composition comprises no more than about 0.75%, by weight, of the detersive surfactant.

10. The overall non-immersion cleaning process of claim 1, wherein the chelating agent is an amino phosphonate chelator.

11. The overall non-immersion cleaning process of claim 1, wherein the spot cleaning composition comprises from about 95% to about 99%, by weight, of water and is formulated at a pH of from about 3 to about 8.

* * * * *